US006270200B1

(12) United States Patent
Ishinaga et al.

(10) Patent No.: US 6,270,200 B1
(45) Date of Patent: Aug. 7, 2001

(54) METHOD AN APPARATUS FOR DISCHARGING LIQUID BY A GAS BUBBLE CONTROLLED BY A MOVEABLE MEMBER TO COMMUNICATE WITH THE ATMOSPHERE

(75) Inventors: Hiroyuki Ishinaga, Arakawa-ku; Sadayuki Sugama, Tsukuba; Toshio Kashino, Chigasaki; Takeshi Okazaki, Sagamihara; Aya Yoshihira; Kiyomitsu Kudo, both of Yokohama; Yoshie Asakawa, Hotaka-machi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/879,278

(22) Filed: Jun. 19, 1997

(30) Foreign Application Priority Data

Jun. 20, 1996 (JP) ..... 8-159806

(51) Int. Cl.[7] ..... B41J 2/05; B41J 2/19
(52) U.S. Cl. ..... 347/65; 347/92
(58) Field of Search ..... 347/65, 63, 56, 347/48, 94, 92

(56) References Cited

U.S. PATENT DOCUMENTS

| | | | | |
|---|---|---|---|---|
| 4,410,899 | | 10/1983 | Haruta et al. | 347/56 |
| 4,638,337 | | 1/1987 | Torpey et al. | 347/65 |
| 4,723,129 | | 2/1988 | Endo et al. | 347/56 |
| 4,740,796 | | 4/1988 | Endo et al. | 347/56 |
| 5,270,730 | * | 12/1993 | Yaegashi | 347/56 |
| 5,278,585 | | 1/1994 | Karz et al. | 347/65 |
| 5,467,112 | | 11/1995 | Mitani | 347/54 |
| 5,821,962 | * | 10/1998 | Kudo | 347/65 |

FOREIGN PATENT DOCUMENTS

| | | | | |
|---|---|---|---|---|
| 19505465A1 | | 8/1995 | (DE) | B41J/2/05 |
| 0 454 155 | * | 10/1991 | (EP) | B41J/2/05 |
| 0641654A | | 3/1995 | (EP) | B41J/2/05 |
| 58-42466 | * | 3/1983 | (JP) | B41J/3/04 |
| 59-167268 | * | 9/1984 | (JP) | B41J/3/04 |
| 61249768 | | 11/1986 | (JP) | B41J/3/04 |
| 3-81155 | * | 4/1991 | (JP) | B41J/2/05 |
| 3-190746 | * | 8/1991 | (JP) | B41J/2/05 |
| 5-16365 | | 1/1993 | (JP) | B41J/2/05 |
| 05124189 | | 5/1993 | (JP) | B41J/2/05 |

* cited by examiner

*Primary Examiner*—Joan Penedegrass
(74) *Attorney, Agent, or Firm*—Fitzpatrick, Cella, Harper & Scinto

(57) ABSTRACT

There is disclosed a liquid discharging method and apparatus in which a bubble is formed and grown in the liquid is communicated with atmosphere at an area of a discharge opening, and in which a movable member having a free end which guides the bubble toward the discharge opening while regulating growth of the bubble.

74 Claims, 20 Drawing Sheets

METHOD AN APPARATUS FOR DISCHARGING LIQUID BY A GAS BUBBLE CONTROLLED BY A MOVEABLE MEMBER TO COMMUNICATE WITH THE ATMOSPHERE

BACKGROUND OF THE INVENTION

1. Field of the Invention

The present invention relates to recording method and apparatus using a process for communicating a bubble formed by utilizing thermal energy with atmosphere.

The present invention is applicable to printers for effecting the recording on a recording medium such as a paper sheet, a thread sheet, a fiber sheet, a cloth, a leather sheet, a metal sheet, a plastic sheet, glass, wood, ceramic sheet and the like, copying machines, facsimiles having a communication system, ETWs having keyboard input, and word processors, and to composite equipments.

Incidentally, in this specification and claims, a term "recording" means not only application of a significant image such as a character or a figure onto a recording medium but also application of a meaningless image such as a pattern onto a recording medium.

2. Related Background Art

Regarding practical recording methods applicable to various recent printers, an ink jet system in which a liquid droplet is formed by using a bubble generated by film-boiling caused by thermal energy (as disclosed in U.S. Pat. Nos. 4,723,129 and 4,740,796) is effective. Further, U.S. Pat. No. 4,410,899 discloses a recording method in which a liquid passage is not closed or blocked during generation of a bubble.

Although the techniques disclosed in the above U.S. patents can be applied to various recording systems, the above U.S. patents do not disclose or teach application to a system in which the recording is effected by communicating a bubble generated with atmosphere. Such a system is referred to as "atmosphere communication system" or "atmosphere communication type" hereinafter.

By the way, among the atmosphere communication system, an atmosphere communication system using rupture of the bubble does not provide stable liquid discharging, and, thus, is not practical.

Further, although a discharging principle is not known, a wishful phenomenon is disclosed in the Japanese Patent Application Laid-open No. 54-161935. In this technique, a cylindrical heater is disposed in each cylindrical nozzle so that the interior of the nozzle is divided into two by a bubble generated. In this arrangement, a liquid droplet can be formed, but, at the same time, a number of fine or minute liquid droplets are also formed due to "splash".

The Japanese Patent Application Laid-open No. 5-16365 discloses the invention in which the atmosphere communication system is improved up to a practical level.

The invention disclosed in the above Japanese Patent Application Laid-open No. 5-16365 aims to communicate a bubble generated for discharging an ink droplet from a discharge nozzle with atmosphere outside of the discharge nozzle in the vicinity of the discharge outlet. In the above Japanese Patent Application Laid-open No. 5-16365, a position of a thermal energy generating means for generating the bubble and pressure of the generated bubble are regulated or selected, and various parameters for communicating the bubble with the atmosphere under the regulated conditions, kind of liquid, configuration of the discharge outlet and a drive condition for generating the thermal energy are concretely specified. And, with the arrangement as mentioned above, the liquid discharging can be achieved with a good re-filling feature and without generating the splash and ink mist, and a recording apparatus having good frequency response and capable of providing a high quality image can be obtained. Further, since the bubble generated for effecting the liquid discharging is communicated with the atmosphere during the liquid discharging operation, a waiting time for disappearing the bubble in the liquid is not required, thereby achieving the high speed recording.

On the other hand, regarding liquid discharging techniques in which a bubble is generated and then disappeared in a liquid passage, U.S. Pat. No. 4,638,337 discloses the fact that the bubble is communicated with atmosphere in a nozzle due to retardation of a part of meniscus into the nozzle, thereby causing inconvenience. Incidentally, the above U.S. patent merely discloses the invention in which the bubble is surely generated and disappeared in the nozzle in order to eliminate a phenomenon that the bubble is communicated with the atmosphere in the nozzle due to the retardation of the meniscus into the nozzle.

Among the recording apparatuses of atmosphere communication type, in the recording apparatus disclosed in the above Japanese Patent Application Laid-open No. 54-161935, the discharging principle is not obvious, the practical level is not reached and it is difficult to put it to a practical use.

Although the invention disclosed in the above Japanese Patent Application Laid-open No. 5-16365 has the above-mentioned advantage, the following improvements may be desired to provide a recording apparatus having good frequency response and capable of obtaining a high quality image:

Firstly, since the bubble is grown outside of the discharge opening because a bubble generating portion is situated in the vicinity of the discharge opening, a volume of the liquid passage cannot be used effectively, with the result that a volume of the discharged liquid becomes smaller. This must be improved.

Secondly, since a bubble generating condition itself of the bubble generating portion for communicating the bubble with the atmosphere is greatly limited, an allowable design range of a recording head and kinds of liquids which can be used in the recording apparatus are also limited. This must be improved.

Thirdly, if the formation of the bubble is unstable in dependence upon change in environmental condition (for example, temperature, humidity and the like), since the unstable bubble formation directly affects an influence upon the communication between the bubble and the atmosphere, the unstable bubble formation affects an influence upon the discharged liquid (liquid droplet), thereby affecting an influence upon the recording. This should be improved.

Fourthly, regarding the discharging efficiency, there is energy loss. This should also be improved.

Lastly, since the re-filling feature cannot be improved, the frequency response is limited. This must be improved.

SUMMARY OF THE INVENTION

The present invention aims to eliminate the above-mentioned conventional drawbacks.

A first object of the present invention is to provide a liquid discharging system and a liquid discharging method, a liquid droplet discharging head used in such system and method, and a recording apparatus using such a discharging head, in which a condition that a bubble is communicated with atmosphere outside of a discharge opening is optimized while improving discharging efficiency, a discharging amount or a discharging speed.

A second object of the present invention is to provide a new liquid discharging head of atmosphere communication type which can eliminate the above-mentioned limitations in conventional liquid discharging heads of atmosphere communication type, can widen an allowable design range greatly and can discharge ink with high accuracy.

A third object of the present invention is to provide a liquid discharging method, a liquid droplet discharging head used in such system and method, and a recording apparatus using such a discharging head, which can eliminate limitation in the above-mentioned re-filling feature of conventional liquid discharging systems of atmosphere communication type, can improve a re-filling feature and can achieve high level frequency response.

A fourth object of the present invention is to permit the discharging of liquids in which deposit can easily be formed and/or suction discharge liquids.

In addition, a fifth object of the present invention is to provide a preserving method for maintaining reliability of a new liquid droplet discharging head capable of achieving at least one of the above objects for a long time.

The other objects of the present invention will be apparent from the following detailed explanation of the invention referring to the accompanying drawings.

According to the present invention, there is provided a discharging method for discharging liquid by communicating a bubble formed and grown in the liquid with atmosphere at an area of a discharge opening, comprising the step of causing displacement of a movable member having a free end for guiding the bubble toward the discharge opening while controlling the growth of the bubble, in accordance with the growth of the bubble.

In this case, in order to perform the re-filling of the liquid after the liquid discharging, when the bubble is communicated with the atmosphere, a liquid passage communicated with a liquid supply source to receive the liquid from the liquid supply source may not be blocked by the bubble. communicated with the atmosphere in a condition that inner pressure of the bubble is lower than the atmospheric pressure.

In addition, in order to reduce the inner pressure of the bubble below the atmospheric pressure during the communication between the bubble and the atmosphere, a heat generating element for generating the bubble in the liquid may be used, and the bubble generated in the liquid by the heat generating element may be communicated with the atmosphere through the discharge opening under a condition that a distance 1*a* between an end of the heat generating element nearer to the discharge opening and an end of the bubble nearer to the discharge opening and a distance 1*b* between an end of the heat generating element remote from the discharge opening and an end of the bubble remote from the discharge opening may be selected to $\mathbf{1}a/\mathbf{1}b \geqq 1$.

Further, after the bubble was communicated with the atmosphere, the movable member may repel the atmosphere out of the discharge opening.

In order to discharge the bubble in the liquid into the atmosphere after the bubble was communicated with the atmosphere, the movable member may be displaced by generating a bubble not contributing to the liquid discharging.

Further, in order to prevent the bubble from remaining in the liquid, the atmosphere may be released by a tapered portion provided in the vicinity of the free end of the movable member when the movable member is returned to its initial condition.

The present invention may provide a liquid discharging head comprising a first liquid passage communicated with a discharge opening, a second liquid passage having a bubble generating area, and a movable member disposed between the first liquid passage and the bubble generating area, and wherein the movable member is displaced by generating a bubble in the bubble generating area so that the bubble is guided toward the discharge opening while regulating growth of the bubble.

In this case, the liquid supplied to the first liquid passage may be the same as the liquid supplied to the second liquid passage.

Alternatively, the liquid supplied to the first liquid passage may differ from the liquid supplied to the second liquid passage.

Further, a heat generating element for generating the bubble in the liquid may be provided at a position confronting to the movable member, and the bubble generating area may be defined between the movable member and the heat generating element.

In this case, a free end of the movable member may be situated at a downstream side of a center of an area of the heat generating element in a liquid flowing direction.

Further, stepped portions for defining a recess extending from the heat generating element toward an upstream direction may be formed on a substrate on which the heat generating elements are disposed, by pattern-etching, and a second heat generating element may be disposed on an inclined surface defining the stepped portions and inclining toward the discharge opening.

The present invention provides a liquid discharging head capable of performing the above-mentioned liquid discharging method. The liquid discharging head serves to discharge liquid by communicating a bubble generated in the liquid at an area of a discharge opening by growing the bubble and has a movable member having a free end for guiding the bubble toward the discharge opening while controlling the growth of the bubble as the bubble is growing.

When the bubble is communicated with the atmosphere, a liquid passage communicated with a liquid supply source to receive the liquid from the liquid supply source may not be blocked by the bubble.

Further, the bubble may be communicated with the atmosphere in a condition that inner pressure of the bubble is lower than the atmospheric pressure.

In addition, a heat generating element for generating the bubble in the liquid may be used, and the bubble generated in the liquid by the heat generating element may be communicated with the atmosphere through the discharge opening under a condition that a distance 1*a* between an end of the heat generating element nearer to the discharge opening and an end of the bubble nearer to the discharge opening and a distance 1*b* between an end of the heat generating element remote from the discharge opening and an end of the bubble remote from the discharge opening may be selected to $\mathbf{1}a/\mathbf{1}b \geqq 1$.

Further, after the bubble was communicated with the atmosphere, the movable member may repel the atmosphere out of the discharge opening.

In order to prevent the bubble from remaining in the liquid, the atmosphere may be released by a tapered portion provided in the vicinity of the free end of the movable member when the movable member is returned to its initial condition.

The present invention also provides a liquid discharging head comprising a first liquid passage communicated with a discharge opening, a second liquid passage having a bubble generating area, and a movable member disposed between the first liquid passage and the bubble generating area, and wherein the movable member is displaced by a bubble generated in the bubble generating area so that the bubble is guided toward the discharge opening while regulating growth of the bubble.

In this case, the liquid supplied to the first liquid passage may be the same as the liquid supplied to the second liquid passage.

Alternatively, the liquid supplied to the first liquid passage may differ from the liquid supplied to the second liquid passage.

Further, a heat generating element for generating the bubble in the liquid may be provided at a position confronting to the movable member, and the bubble generating area may be defined between the movable member and the heat generating element.

In this case, a free end of the movable member may be situated at a downstream side of a center of an area of the heat generating element in a liquid flowing direction.

Further, stepped portions for defining a recess extending from the heat generating element toward an upstream direction may be formed on a substrate on which the heat generating elements are disposed, by pattern-etching, and a second heat generating element may be disposed on an inclined surface defining the stepped portions and inclining toward the discharge opening.

The present invention provides a head cartridge comprising a liquid discharging head having the above-mentioned construction, and a liquid container for containing liquid to be supplied to the liquid discharging head.

In this case, when a liquid discharging head having a first liquid passage and a second liquid passage is used, the head cartridge may include the liquid discharging head, and a liquid container for containing liquid to be supplied to the first liquid passage and liquid to be supplied to the second liquid passage.

The present invention further provides a recording apparatus comprising a liquid discharging head having the above-mentioned construction, and a drive signal supplying means for supplying a drive signal for discharging the liquid from the liquid discharging head.

The recording apparatus may include a recording medium conveying means for conveying a recording medium for receiving the liquid discharged from the liquid discharging head.

The present invention provides a head kit comprising a liquid discharging head having the above-mentioned construction, and a liquid container for containing liquid to be supplied to the liquid discharging head.

As mentioned above, the growing direction of the bubble can be directed toward the discharge opening by the movable member for controlling the growing direction of the bubble, thereby improving the discharging efficiency. Further, since the returning direction (to the initial condition) of the movable member after the liquid discharging coincides with a liquid re-filling direction, re-filling frequency and discharge repeating frequency can be increased, thereby permitting high speed recording.

Incidentally, in the specification and claims, the terms "upstream" and "downstream" are referred to regarding the liquid flowing direction from the liquid supply source through the bubble generating area (or movable member) to the discharge opening, or the constructural direction.

Further, the term "downstream side" regarding the bubble itself mainly means a discharge opening side portion of the bubble directly relating the liquid discharging. More particularly, it means a bubble portion generated at a downstream of a center of the bubble in the liquid flowing direction or the constructural direction or at downstream of a center of the area of the heat generating element.

In addition, the term "separation wall" means a wall (which may include the movable member) disposed to separate the bubble generating area from a area directly communicated with the discharge opening in a broader sense, and means a wall for distinguishing the liquid passage including the bubble generating area from the liquid passage directly communicated with the discharge opening and for preventing the mixing of the liquids in both liquid passages in a narrower sense.

DETAILED DESCRIPTION OF THE PREFERRED EMBODIMENTS

The present invention will now be explained in connection with embodiments thereof with reference to the accompanying drawings.

Figure 1:
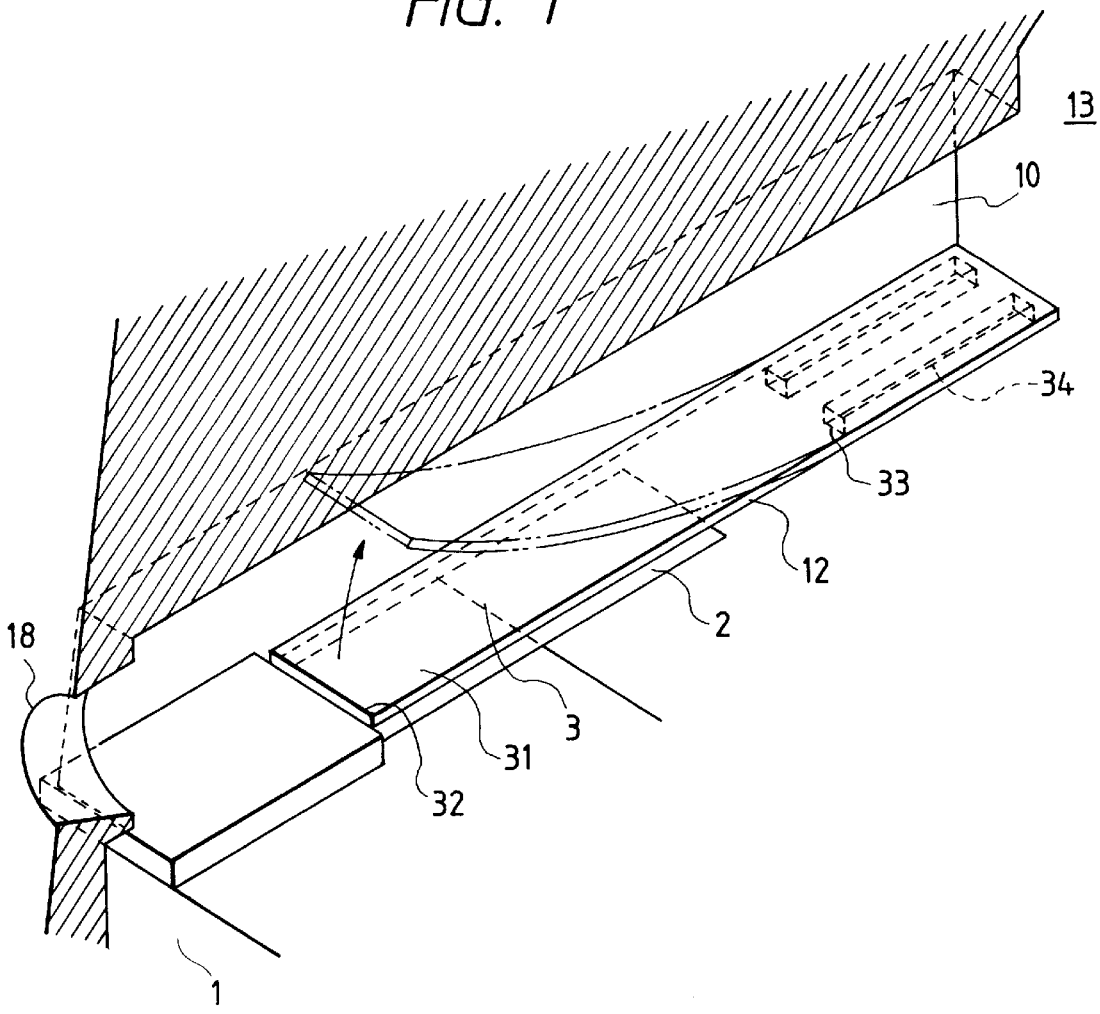
FIG. 1 is a partial sectional perspective view of a discharge nozzle portion of a liquid discharging head according to an embodiment of the present invention.

FIG. 1 is a partial sectional perspective view of a discharge nozzle portion of a liquid discharging head according to an embodiment of the present invention.

The liquid discharging head according to the illustrated embodiment includes an element substrate 1 on which a heat generating element 2 (rectangular heat generating resistance member having a dimension of 40 $\mu$m×105 $\mu$m, in the illustrated embodiment) for acting thermal energy on liquid (as discharge energy generating element for generating energy for discharging the liquid) is arranged, and a liquid passage 10 is formed above the element substrate 1 in correspondence to the heat generating element 2. The liquid passage 10 communicates with a discharge opening 18 and also communicates with a common liquid chamber 13 for supplying the liquid to a plurality of liquid passages 10, and receives the liquid corresponding to the discharged liquid from the common liquid chamber 13.

In the liquid discharging head according to the illustrated embodiment, the heat generating element 2 is disposed nearer to the discharge opening 18. This arrangement provides a most simple means for communicating a bubble with atmosphere.

Within the liquid passage 10, above the element substrate 1, a movable member 31 having a flat surface portion and formed from material having elasticity such as metal is disposed in a cantilever fashion in a confronting relation to the heat generating element 2. One end of the movable member 31 is secured to bases (support member) 34 formed by patterning photosensitive resin on walls of the liquid passage 10 and on the element substrate 1. As a result, the movable member 31 is held in such a manner that the movable member can be displaced around a fulcrum (support portion) 33.

The movable member 31 has the fulcrum (support portion; fixed end) 33 positioned at an upstream side of large flow of liquid flowing from the common liquid chamber 13 through the movable member 31 to the discharge opening 18 and a free end (free end portion) 32 disposed at a downstream side of the fulcrum 33, and is disposed in a confronting relation to the heat generating element 2 to cover the heat generating element 2 and is spaced apart from the heat generating element 5 upwardly by about 15 $\mu$m. A bubble generating area is defined between the heat generating element 2 and the movable member 31. Incidentally, kinds, configurations and dispositions of the heat generating element 2 and the movable member 31 are not limited to the above-mentioned ones, but, the heat generating element and the movable member may be configured and disposed to control the growth of the bubble and transmission of the pressure, which will be described later. Incidentally, for the explanation of a liquid flow which will be described later, the liquid passage 10 is explained to have a first liquid passage 14 (at one side of the movable member 31) directly communicated with the discharge opening 18 and having a discharge area including a major part of liquid to be discharged and a second liquid passage 16 (at the other side of the movable member) including the bubble generating area for generating the bubble for discharging the liquid disposed at the downstream side of the movable member 31.

Now, a liquid discharging principle according to the illustrated embodiment will be explained.

Heat is applied to the liquid in the bubble generating area between the movable member 31 and the heat generating element 2 by heating the heat generating element 2, and a bubble is formed in the liquid by a film-boiling phenomenon as disclosed in U.S. Pat. No. 4,723,129. Pressure caused by the formation of the bubble, and the bubble act on the movable member preferentially to displace the movable member 31 around the fulcrum 33 to be greatly opened toward the discharge opening 18, as shown by the broken line in FIG. 1. By the displacement or a displaced condition of the movable member 31, a transmitting direction of the pressure caused by the formation of the bubble and a growing direction of the bubble itself are oriented toward the discharge opening.

Now, one of fundamental discharging principles of the present invention will be described. The most important principle of the present invention is to displace or shift the movable member 31 (disposed in a confronting relation to the bubble) from a first position (normal condition) to a second position (displaced condition) by the pressure of the bubble or the bubble itself, so that the pressure caused by the formation of the bubble and the bubble itself are oriented to a downstream side in which the discharge opening 18 is disposed, by the displaced movable member 31.

Figure 2:
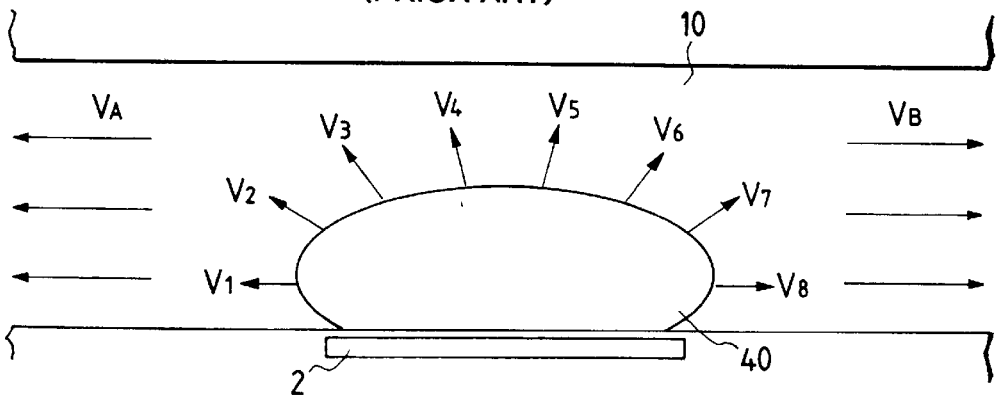
FIG. 2 (PRIOR ART)
FIG. 2 is a schematic view showing pressure transmission from a bubble in a conventional head.
Figure 3:
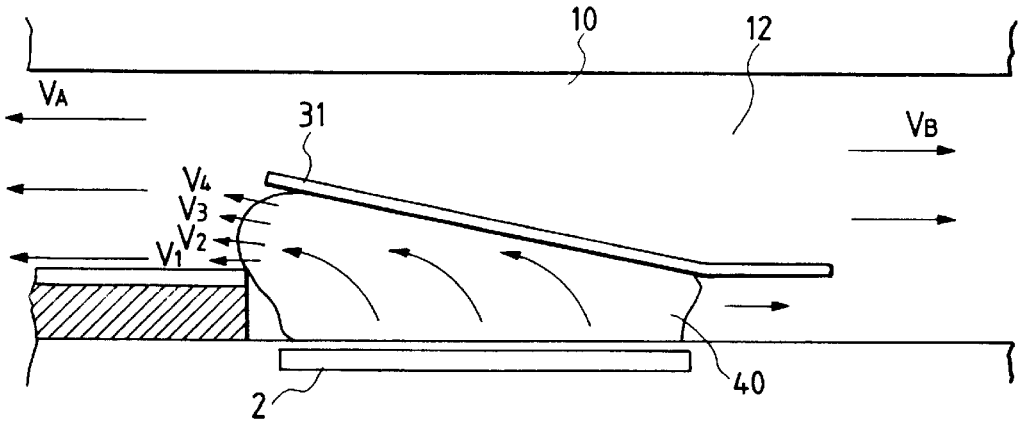
FIG. 3 is a schematic view showing pressure transmission from a bubble in a head according to the present invention.

This principle will be fully explained while comparing FIG. 2 (schematically showing a structure of a conventional liquid passage not having the movable member 31) and FIG. 3 (showing the present invention). Incidentally, here, the pressure transmitting direction toward the discharge opening is shown by the arrows VA and a pressure transmitting direction toward the upstream side (i.e., toward the common liquid chamber) is shown by the arrows VB.

In the conventional head as shown in FIG. 2, there is no means for regulating a transmitting direction of the pressure caused by formation of a bubble 40. Thus, the pressure of the bubble 40 is transmitted toward various directions as shown by the arrows V1–V8 perpendicular to a surface of the bubble. Among them, the pressure transmitting directions V1–V4 have components directing toward the direction VA which is most effective to the liquid discharging, and the pressure transmitting directions V1–V4 are positioned on a left half of the bubble near the discharge opening and contribute to the liquid discharging efficiency, liquid discharging force and liquid discharging speed. Further, since the pressure transmitting direction V1 is directed to the discharging direction VA, it is most effective; whereas, the pressure transmitting direction V4 has smallest component directing toward the discharging direction VA.

To the contrary, in the present invention shown in FIG. 3, the pressure transmitting directions V1–V4 which are directed to various directions in FIG. 2 are oriented toward the downstream side (i.e., toward the discharge opening) by the movable member 31 (i.e., various pressure transmitting directions is converted to the downstream direction VA), with the result that the pressure of the bubble 40 contributes to the liquid discharging directly and effectively. Similar to the pressure transmitting directions V1–V4, the growing direction of the bubble is directed toward the downstream side (i.e., toward the discharge opening), with the result that the bubble is grown more greatly at the downstream side than at the upstream side. By controlling the growing direction of the bubble 40 itself and the pressure transmitting direction of the bubble 40 by means of the movable member 31, the discharging efficiency, discharging force and discharging speed can be improved.

Next, a discharging operation of the liquid discharging head according to the illustrated embodiment will be fully described with reference to FIGS. 4A to 4D and FIGS. 5E to 5H.

Figure 4A:
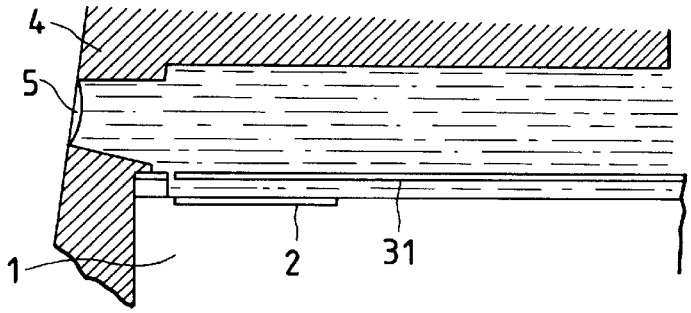
FIGS. 4A, 4B, 4C, 4D, and FIGS. 5E, 5F, 5G, 5H are sectional views showing a discharging operation according to a first embodiment of the present invention.

FIG. 4A shows a condition before energy such as electrical energy is applied to the heat generating element 2, i.e., before heat is generated from the heat generating element 2. It is important that the movable member 31 is disposed in a confronting relation to at least a downstream portion of the bubble 40 which will be formed by the heat from the heat generating element 2. That is to say, the movable member 31 extends up to at least a position downstream of a center of an area of the heat generating element in the liquid passage (i.e., downstream of a line passing through the center of the area of the heat generating element and extending perpendicular to the length of the liquid passage) so that the downstream portion of the bubble acts on the movable member. Particularly, in the present invention in which the bubble is directed toward the discharge opening by the movable member, it is more desirable that the movable member extends up to an end of the heat generating element nearer to the discharge opening.

Figure 4B:
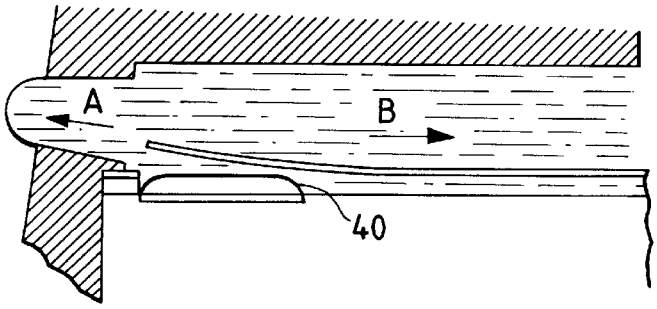

FIG. 4B shows a condition that the heat generating element 2 is heated by applying the electrical energy to the heat generating element 2 and the bubble 40 is formed by the film-boiling caused by heating a portion of the liquid contained in the bubble generating area by utilizing the heat from the heat generating element.

In this case, the movable member 31 is displaced or shifted by the pressure caused by the formation of the bubble 40 from the first position to the second position to direct the pressure transmitting direction of the bubble 40 toward the discharge opening 18 (FIG. 1). In this case, the liquid flows not only in a direction A (toward the discharge opening 18) but also in an upstream direction B.

Here, it is important that, as mentioned above, the free end 32 of the movable member 31 is disposed at the downstream side and the fulcrum 33 shown in FIG. 1 is disposed at the upstream side (near the common liquid chamber) and at least a portion of the movable member is faced to the downstream portion of the heat generating element (i.e., downstream portion of the bubble).

Figure 4C:
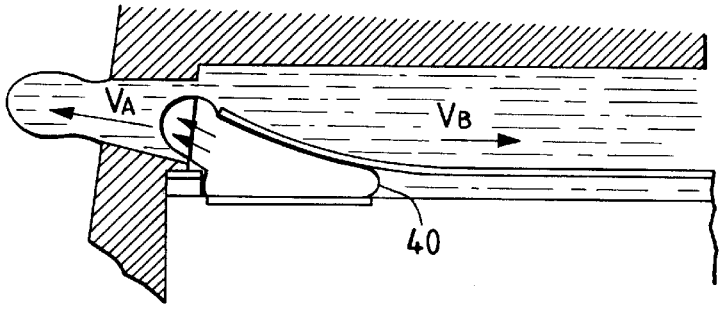

FIG. 4C shows a condition that the bubble 40 is further growing and the movable member 31 is further displaced by the pressure caused by the growth of the bubble 40. The generated bubble 40 is grown more greatly at the downstream side than at the upstream side, and the bubble is greatly grown to exceed the first position (shown in FIG. 4A) of the movable member 31. Further, when it is assumed that the growth of the bubble around the heat generating element 2 is a first wave, since a second wave is generated at an end of the movable member 31, the bubble 40 is expanded upwardly so that the bubble has a uniform shape with respect to the discharge opening. When the bubble 40 and the bubble pressure are oriented toward the discharge opening 18, the movable member 31 does almost not regulate such orientation, with the result that the transmitting direction of the pressure and the growing direction of the bubble can be controlled efficiently in accordance with the magnitude of the pressure transmitted.

As mentioned above, since the movable member 31 is gradually displaced as the bubble 40 is growing, the pressure transmitting direction of the bubble 40 is regulated to a direction toward which the pressure transmitting direction is apt to be oriented or the volume of the bubble is apt to be shifted (i.e., to the free end), with the result that the growing direction of the bubble is uniformly oriented toward the discharge opening 18. Further, a liquid flowing speed VA toward the discharge opening 18 (direction A) is sufficiently greater than a liquid flowing speed VB toward the upstream side (direction B), the discharging efficiency can be increased.

Figure 4D:
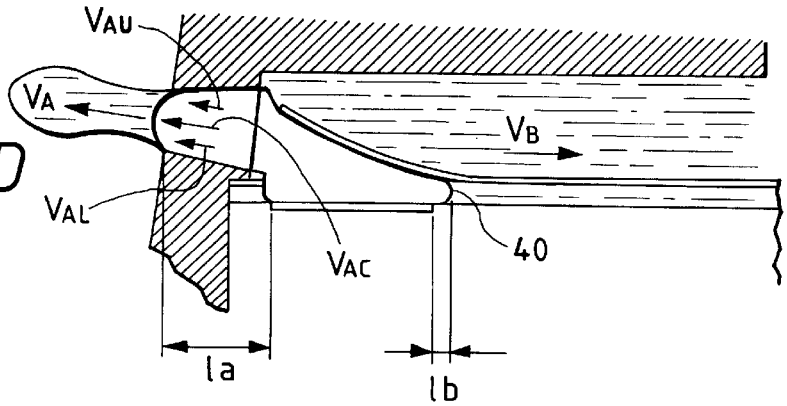

FIG. 4D shows a condition immediately before the bubble 40 is communicated with the atmosphere. In FIG. 4D, the arrows (speeds) $V_{AU}$, $V_{AC}$, $V_{AL}$ represent distribution of the speed VA, regarding the central speed $V_{AC}$, upper speed distribution is shown by the speed $V_{AU}$ and lower speed distribution is shown by the speed $V_{AL}$. Regarding the speed of the liquid as the bubble 40 is growing, as mentioned above, since the bubble is grown to have the uniform shape with respect to the discharge opening, the liquid speeds near the central speed $V_{AC}$ become uniform, and, since the bubble is communicated with the atmosphere in such a condition, the liquid can be discharged from the discharge opening without offset regarding a discharge plane. Also at this point, since the bubble 40 in the liquid passage is still growing, the liquid passage 10 (FIG. 3) is not completely blocked or closed, the re-filling feature for subsequent liquid supply is improved.

In the illustrated embodiment, parameters for determining the shape of the generated bubble 40 includes material and configuration of the movable member 31, as well as conventional parameters such as a thermal energy amount generated by the heat generating element 2 (based on construction of the heat generating element 2, material from which the heat generating element is formed, driving condition for driving the heat generating element, an area of the heat generating element, heat capacity of the substrate on which the heat generating element 2 is disposed, and the like), physical feature of ink, dimensions of various parts of a recording head (for example, a distance between the discharge opening 18 and the heat generating element 2, heights and widths of the discharge opening 18 and the liquid passage 10, and the like), and the like. By appropriately selecting the parameters, the bubble 40 can be communicated with the atmosphere with a desired condition.

It is preferable that, when the bubble 40 is communicated with the atmosphere, inner pressure of the bubble is substantially the same as the atmospheric pressure or is lower than the atmospheric pressure. In order to achieve such a condition, as shown in FIG. 4D, the bubble 40 may be formed under a condition that a distance 1*a* between an end of the heat generating element 2 nearer to the discharge opening 18 and an end of the bubble 40 nearer to the discharge opening 18 and a distance 1*b* between an end of the heat generating element 2 remote from the discharge opening 18 and an end of the bubble 40 remote from the discharge opening 18 is selected to $1a/1b \geqq 1$. In the illustrated embodiment, the parameters are selected to satisfy the above-mentioned condition. The configuration and material of the movable member 31 are preferential as the parameters for determining the shape of the bubble 40, and, in comparison with the conventional determining method in which the shape of the bubble was determined on the basis of the parameters such as thermal energy amount, physical feature of ink and dimensions of various parts of the recording head, the bubble 40 which satisfies the condition $1a/1b \geqq 1$ can be formed more easily.

Figure 5E:
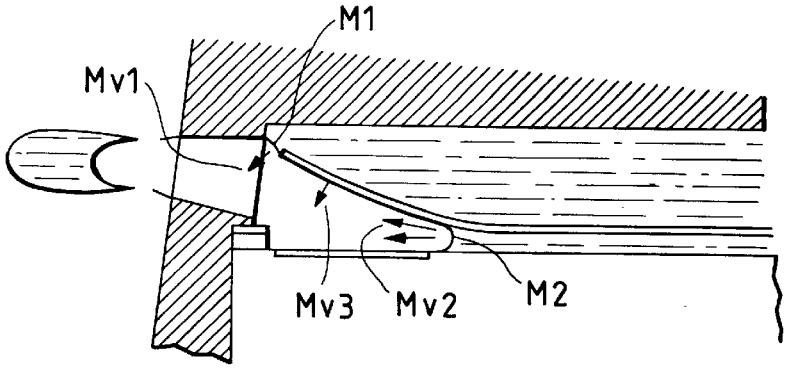

FIG. 5E shows a condition immediately after the bubble 40 was communicated with the atmosphere. As shown, in the illustrated embodiment, since the movable member 31 is provided, in a condition that the bubble 40 is communicated with the atmosphere, the discharged liquid is not offset with respect to the discharge opening to leave from the discharge opening with uniform balance, thereby stabilizing the discharging direction. In this case, meniscus M1 and meniscus M2 are formed above and below the movable member 31, respectively. In general, since a zone below the movable member 31 where the bubble is generated is formed to be smaller than a zone above the movable member where the liquid to be discharged is contained, an advancing speed $M_{V2}$ of the meniscus M2 becomes faster than an advancing speed $M_{V1}$ of the upper meniscus M1. However, in the illustrated embodiment, since a speed $M_{V3}$ for returning the movable member 31 to its initial condition is added to the advancing speed of the meniscus M1, the advancing speeds of the menisci M1, M2 are balanced, thereby increasing the re-filling speed.

Figure 5F:
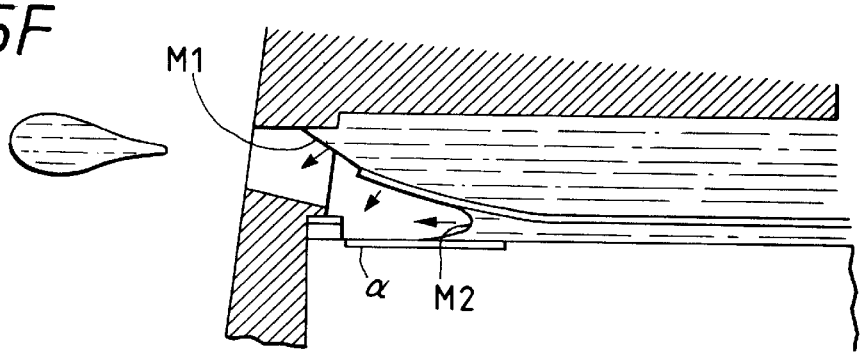

Further, the discharged liquid shown in FIG. 5F includes a large part of the liquid which was contacted with the bubble 40 before the bubble 40 is communicated with the atmosphere. Regarding temperature distribution of the liquid when the bubble 40 is generated, a temperature of the liquid portion contacted with the bubble 40 is greatest. In the illustrated embodiment, since such liquid portion is discharged, increase in temperature of the head can be suppressed.

Figure 5G:
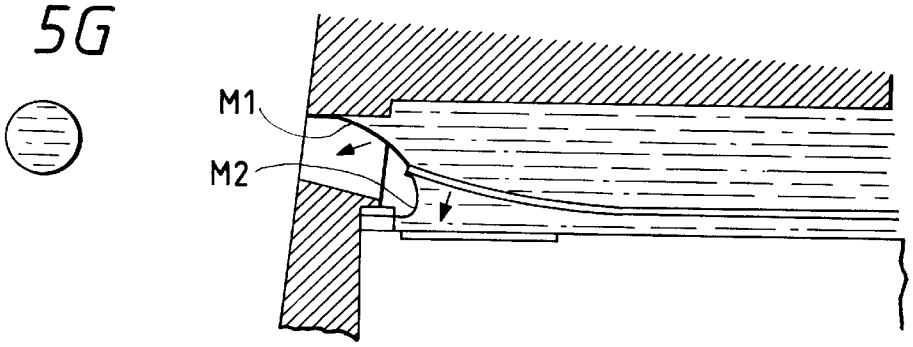
Figure 5H:
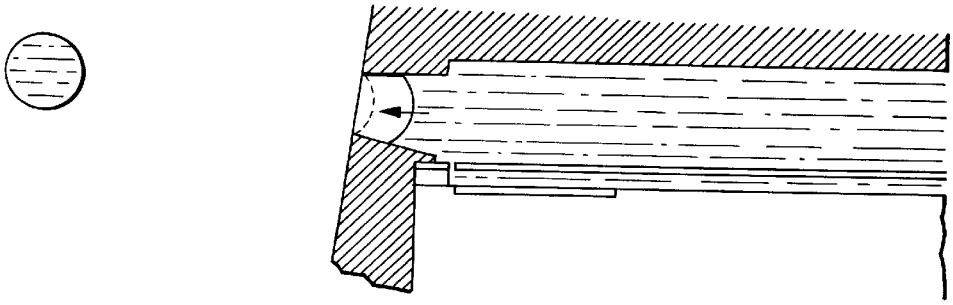

Thereafter, as shown in FIGS. 5F and 5G, although the displacement amount of the movable member 31 is gradually decreased until the movable member is returned to its initial condition, the menisci M1, M2 are maintained above and below the free end of the movable member until the initial condition as shown in FIG. 5H is restored. The movable member 31 is returned to its initial condition while displacing to balance the menisci M1, M2, thereby performing the re-fill.

Now, the above-mentioned re-filling operation will be explained.

First of all, a re-filling operation regarding the zone above the movable member 31 will be described.

As shown in FIG. 5E, when the bubble 40 is communicated with the atmosphere, since the atmospheric pressure is greater than the inner pressure of the bubble 40, the atmospheric pressure enters into the discharge opening (discharge nozzle). In this case, the liquid in the discharge nozzle tries to be retarded by a force of the atmospheric pressure entered into the discharge nozzle and a force (which was generated in the liquid due to the formation of the bubble and which was suppressed by the bubble) for returning the liquid to the upstream side.

The entering of the atmosphere into the discharge nozzle is started at the condition shown in FIG. 5E and the force from the atmospheric pressure becomes maximum in the condition shown in FIG. 5E. In this case, the displacement amount of the movable member 31 is also greatest, with the result that the atmosphere is prevented from entering into the discharge opening, thereby suppressing the retard of the meniscus. Thereafter, the movable member 31 tries to return to the condition shown in FIG. 5H. As mentioned above, the menisci M1, M2 are formed above and below the movable member 31, respectively. When the movable member 31 is gradually shifted downwardly to return to its initial condition, the liquid is also shifted together with the movable member 31 due to viscosity. Since the liquid is shifted in a re-filling direction, the re-filling operation regarding the zone above the movable member 31 can be effected quickly.

Incidentally, the re-filling operation regarding the zone below the movable member 31 is started upon generation of the bubble 40. In this case, when the movable member 31 is gradually shifted upwardly, since the liquid is also shifted in the re-filling direction, the re-filling operation regarding the zone below the movable member 31 can be effected quickly.

As mentioned above, in the illustrated embodiment, the re-filling operations regarding the zones above and below the movable member 31 can be effected quickly. Further, due to the presence of the movable member 31, any vibration can be prevented from occurring during the re-filling operation, with the result that the movable member can be returned to its initial position quickly.

Further, since two menisci are formed, the meniscus can be prevented from growing excessively. In a preferred condition that the inner pressure of the bubble is substantially the same as the atmospheric pressure, since momentum of the liquid flowing toward the upstream side becomes great, it is apprehended that the subsequent re-fill cannot be effected smoothly. However, in the illustrated embodiment, since two menisci are formed to prevent the meniscus from growing excessively, the re-fill due to a capillary phenomenon can be effected efficiently.

Next, a second embodiment of the present invention will be explained.

FIGS. 6A to 6D and 7E to 7G are sectional views showing a discharging operation according to a second embodiment of the present invention.

Although the first embodiment of the present invention is of a type (edge chute type) in which the liquid is discharged along a longitudinal direction of the heat generating element, in this second embodiment, there is provided a liquid discharging head of a type (side chute type) in which a discharge opening is formed in a plane parallel with a surface of a heat generating element 202 and liquid is discharged in a direction perpendicular to the heat generating element. In these Figures, although not shown, a common liquid chamber is provided at the right side of the drawings, and a liquid passage is curved. The heat generating element 202 is formed on a substrate 201 below a curved portion of the liquid passage. Further, a wall for effectively directing a discharge force of a bubble generated by heating the heat generating element 202 toward a discharge opening 205 is disposed at the left of the heat generating element 202. Further, a lower portion of the wall has a tapered end surface (flared toward the substrate 201) for preventing the bubble from remaining in the liquid after the liquid discharging and for remaining the liquid on the heat generating element. By providing such a tapered end surface, when the liquid discharging operation is effected, the liquid always remains at the tapered end surface, thereby preventing the formation of a bubble.

The discharge opening 205 has a cross-sectional area gradually decreased in a liquid discharging direction and is disposed in a confronting relation to the heat generating element 202. An opening/closing movable member 231 is disposed between the discharge opening 205 and the heat generating element 202.

Figure 6A:
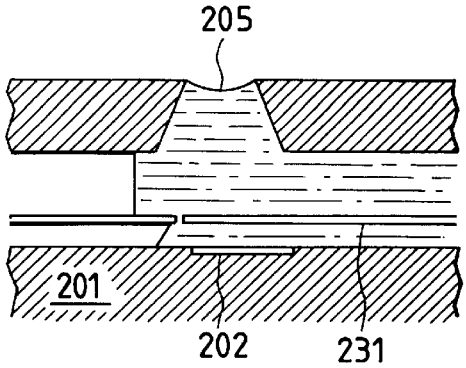
FIGS. 6A, 6B, 6C, 6D, and FIGS. 7E, 7F, 7G are sectional views showing a discharging operation according to a second embodiment of the present invention.

FIG. 6A shows a condition before energy such as electrical energy is applied to the heat generating element 202, i.e., before heat is generated from the heat generating element 202. Also in this embodiment, the movable member 231 is disposed in a confronting relation to at least a downstream portion of a bubble which will be formed by heating the heat generating element 202. That is to say, the movable member 231 extends up to at least a position downstream of a center of an area of the heat generating element 202 in the liquid passage (i.e., downstream of a line passing through the center of the area of the heat generating element and extending perpendicular to the length of the liquid passage) so that the downstream portion of the bubble acts on the movable member 231. Particularly, in the present invention in which the bubble is directed toward the discharge opening by the movable member, it is more desirable that the movable member extends up to an end of the heat generating element nearer to the discharge opening.

Figure 6B:
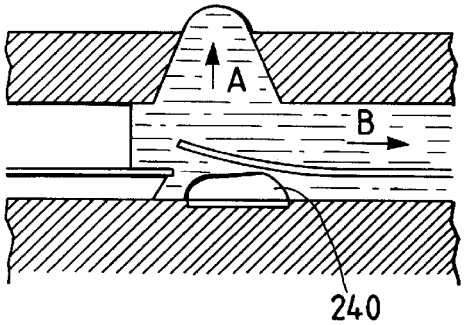

FIG. 6B shows a condition that the heat generating element 202 is heated by applying the electrical energy to the heat generating element 202 and the bubble is formed by the film-boiling caused by heating a portion of the liquid contained in the bubble generating area by utilizing the heat from the heat generating element.

In this case, the movable member 231 is displaced by the pressure caused by the formation of the bubble 240 to direct the pressure transmitting direction of the bubble 240 toward the discharge opening 205 via the wall.

Here, it is important that, as mentioned above, a free end of the movable member 231 is disposed at the downstream side (near the discharge opening 205) and a fulcrum of the movable member 231 is disposed at the upstream side (near the common liquid chamber) and at least a portion of the movable member is faced to the downstream portion of the heat generating element (i.e., downstream portion of the bubble 240).

Figure 6C:
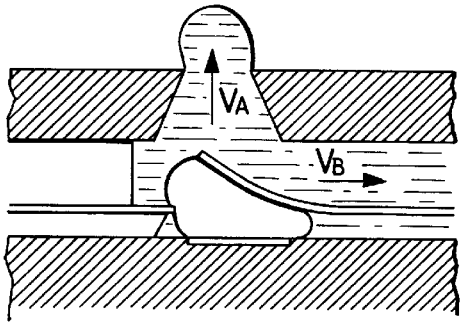

FIG. 6C shows a condition that the bubble 240 is further growing and the movable member 231 is further displaced by the pressure caused by the growth of the bubble 240. The generated bubble 240 is grown more greatly at the downstream side than at the upstream side, and the bubble is greatly grown to exceed an initial position (shown in FIG. 6A) of the movable member 231. When the bubble 240 and the bubble pressure are oriented toward the discharge opening 205, the movable member 231 does almost not regulate such orientation, with the result that the transmitting direction of the pressure and the growing direction of the bubble 240 can be controlled efficiently in accordance with the magnitude of the pressure transmitted.

As mentioned above, since the movable member 231 is gradually displaced as the bubble 240 is growing, the pressure transmitting direction of the bubble 240 is regulated to a direction toward which the pressure transmitting direction is apt to be oriented or the volume of the bubble is apt to be shifted (i.e., to the free end), with the result that the growing direction of the bubble is uniformly oriented toward the discharge opening 205. Further, a liquid flowing speed VA toward the discharge opening 205 (direction A) is sufficiently greater than a liquid flowing speed VB toward the upstream side (direction B), the discharging efficiency can be increased.

Figure 6D:
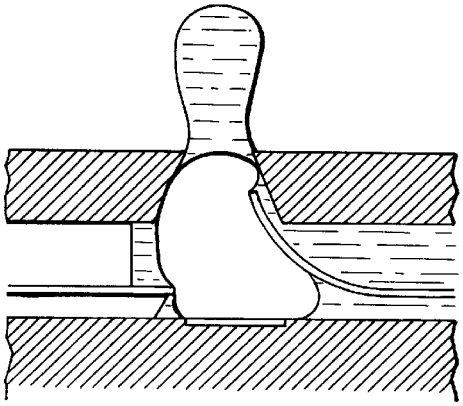

FIG. 6D shows a condition immediately before the bubble 240 is communicated with the atmosphere. Also at this point, since the bubble 240 in the liquid passage is still growing, the liquid passage is not completely blocked or closed, the re-filling feature for subsequent liquid supply is improved. Further, since the bubble 240 has a symmetrical shape with respect to the discharge opening 205 in a direction perpendicular to a surface of the plate-shaped movable member 231, the direction of the discharged liquid is stabilized.

In this embodiment, parameters for determining the shape of the generated bubble 240 include a thermal energy amount generated by the heat generating element 202 (based on construction of the heat generating element 202, material from which the heat generating element is formed, driving condition for driving the heat generating element, an area of the heat generating element, heat capacity of the substrate on which the heat generating element 202 is disposed, and the like), physical feature of ink, dimensions of various parts of a recording head (for example, a distance between the discharge opening 205 and the heat generating element 202, heights and widths of the discharge opening 205 and the liquid passage, and the like), and the like. By appropriately selecting the parameters, the bubble 240 can be communicated with the atmosphere with a desired condition.

Figure 7E:
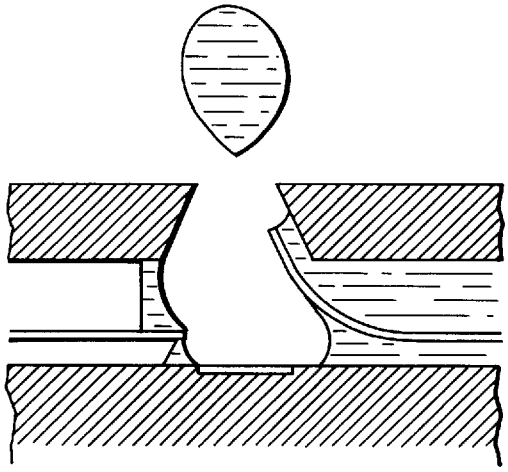

FIG. 7E shows a condition immediately after the bubble 240 was communicated with the atmosphere. As shown, in the illustrated embodiment, since the movable member 231 is provided, in a condition that the bubble 240 is communicated with the atmosphere, the discharged liquid is not offset with respect to the discharge opening to leave from the discharge opening with uniform balance, thereby stabilizing the discharging direction.

Figure 7F:
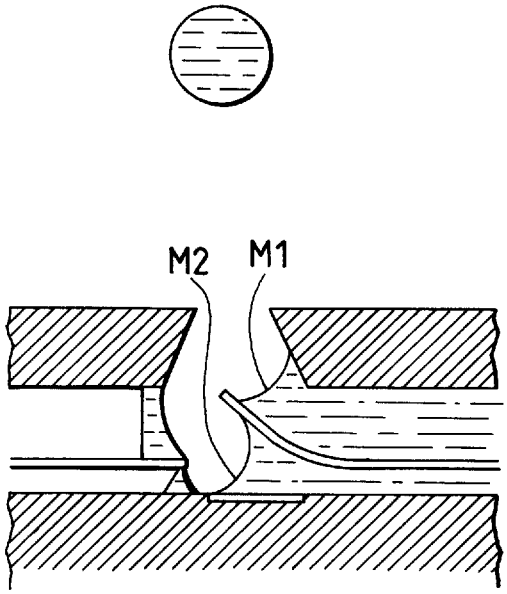

Further, the discharged liquid shown in FIG. 7F includes a large part of the liquid which was contacted with the bubble 240 before the bubble 240 is communicated with the atmosphere. Regarding temperature distribution of the liquid when the bubble 240 is generated, a temperature of the liquid portion contacted with the bubble 240 is greatest. In the illustrated embodiment, since such liquid portion is discharged, increase in temperature of the head can be suppressed.

Figure 7G:
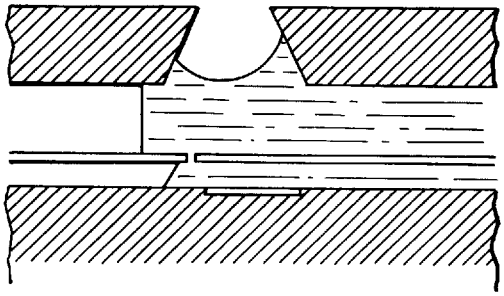
Figure 8A:
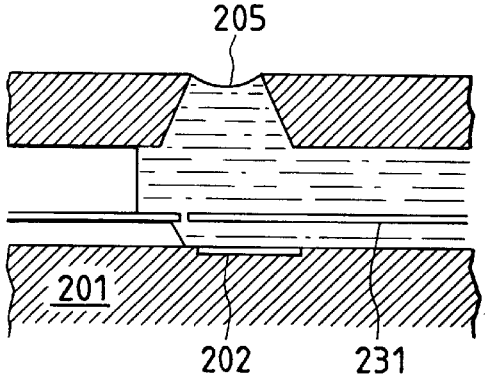
FIGS. 8A, 8B, 8C, 8D, and FIGS. 9E, 9F, 9G are sectional views showing a discharging operation according to a third embodiment of the present invention.
Figure 8B:
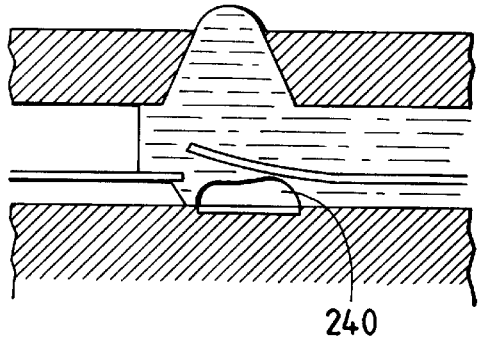
Figure 8C:
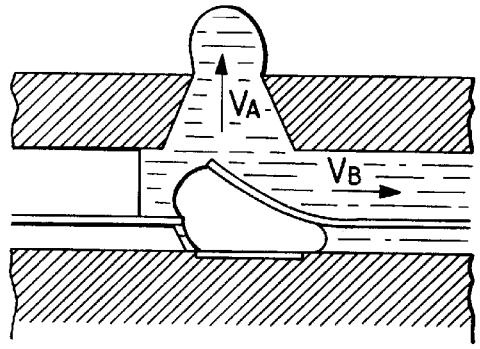
Figure 8D:
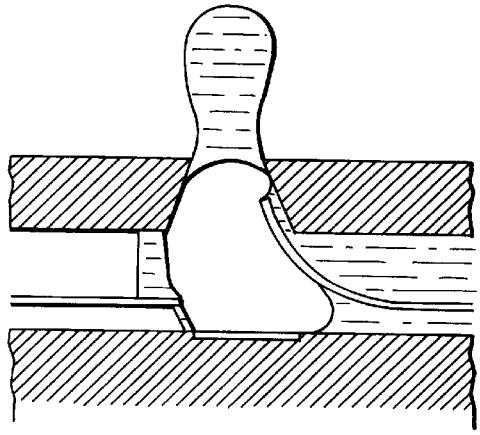
Figure 9E:
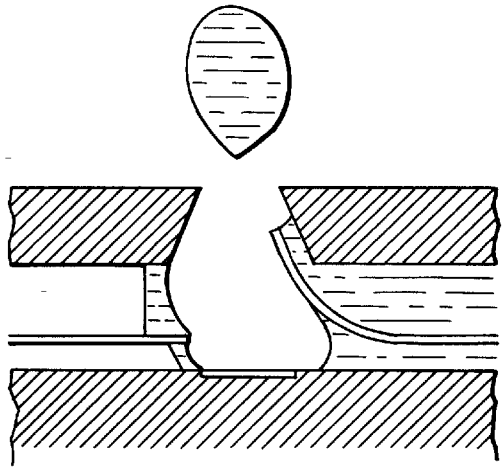
Figure 9F:
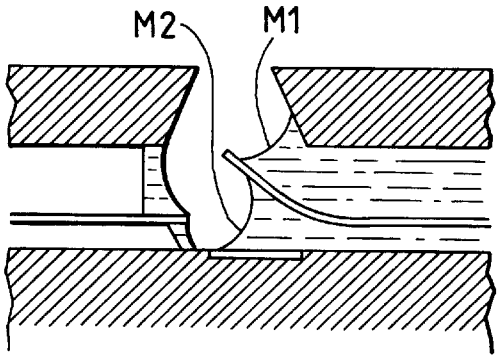
Figure 9G:
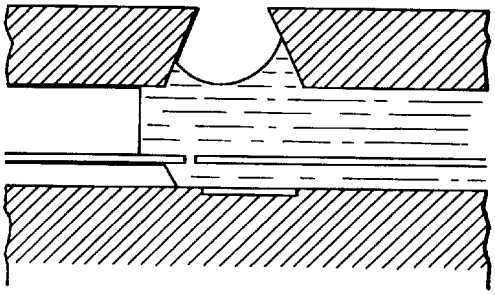

Thereafter, although the displacement amount of the movable member 231 is gradually decreased until the movable member is returned to its initial condition as shown in FIG. 7G, menisci M1, M2 are formed above and below the free end of the movable member 231 until the initial condition as shown in FIG. 7G is restored. The movable member 231 is returned to its initial condition while displacing to balance the menisci M1, M2, thereby performing the re-fill.

The re-filling operation of the second embodiment is similar to the re-filling operation of the embodiment shown in FIGS. 4A to 4D and FIGS. 5E to 5H, and, therefore, the re-filling operation can be effected quickly, and, any vibration can be prevented from occurring during the re-filling operation, with the result that the movable member can be returned to its initial position quickly.

Next, a third embodiment of the present invention will be explained. FIGS. 8A to 8D and FIGS. 9E to 9G are sectional views showing a discharging operation according to a second embodiment of the present invention.

The third embodiment is similar to the second embodiment, except that, in the second embodiment, the tapered end surface for preventing the bubble from remaining in the liquid after the liquid discharging is flared toward the substrate 201, whereas, in the third embodiment, such tapered end surface is converged toward a substrate 201.

Since the liquid discharging operation of the third embodiment is substantially the same as that of the second embodiment, detailed explanation thereof will be omitted.

In the illustrated embodiment, by providing such a tapered end surface, the atmosphere entered into the liquid passage due to the communication between the bubble and the atmosphere is directed toward the discharge opening 205 effectively while the movable member 231 is being returned to its initial condition, with the result that the entered atmosphere is discharged from the discharge opening 205 without remaining any bubble in the zone below the movable member (second liquid passage), and, at the same time, the re-filling speed is improved, thereby permitting the high speed operation. Even if there is any bubbled gas capsuled by the liquid, since such bubbled gas is discharged from the bubble generating area by the displacement and inclination of the movable member 231 and the tapered end surface of the wall, the formation of the bubble and the liquid discharging efficiency are stabilized.

Figure 10:
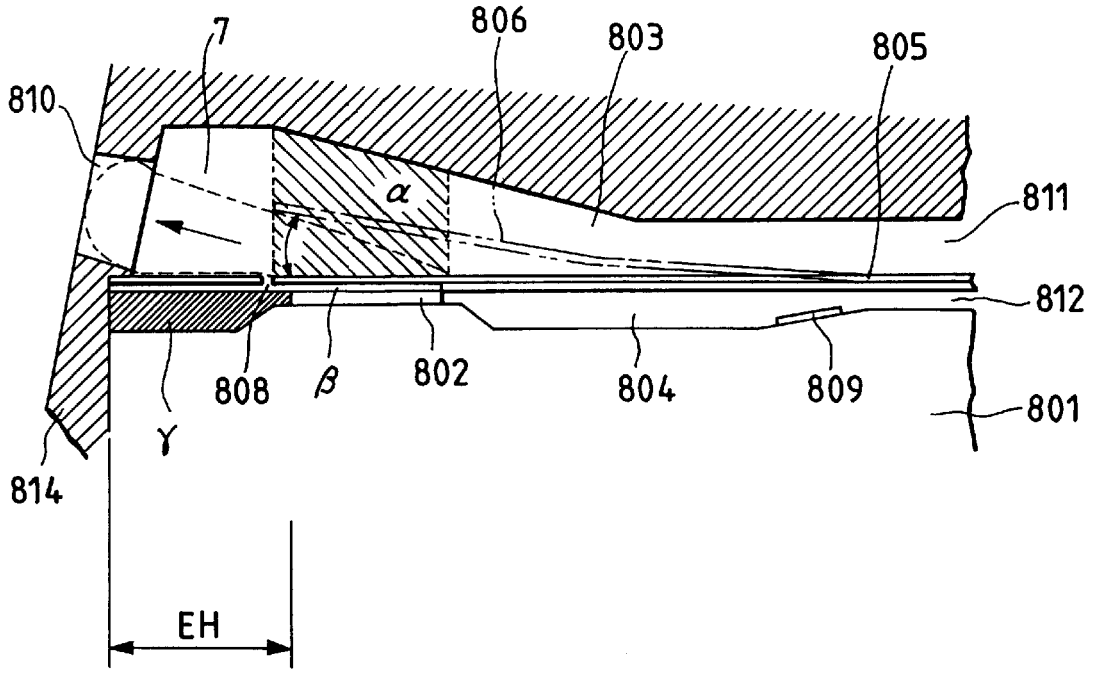
FIG. 10 is a sectional view showing a characteristic of a fourth embodiment of the present invention.

Next, a fourth embodiment of the present invention will be explained. FIG. 10 is a sectional view showing a characteristic of the fourth embodiment.

A liquid discharging head according to the fourth embodiment includes a substrate 801 on which heat generating elements 802 for providing thermal energy for generating a bubble in liquid, second bubble liquid passages 804 disposed on the substrate, and first discharge liquid passages 803 directly communicated with respective discharge openings 810.

A separation wall 805 made of material having elasticity such as metal is disposed between the first liquid passages 803 and the second liquid passages 804, thereby isolating the discharge liquid in the first liquid passages 803 from the bubble liquid in the second liquid passages 804.

A portion of the separation wall disposed in a projected space (referred to as "discharge generating area" hereinafter; area a and a bubble generating area β in FIG. 10) above the heat generating element 802 is defined, by a slit 808, as a cantilever movable member 806 having a free end near the discharge opening (downstream side in the liquid flowing direction) and a fulcrum near common liquid chambers (811, 812). Since the movable member 806 is disposed in a confronting relation to the bubble generating area β, as is in the first embodiment, the movable member is opened toward the first liquid passage 803 (i.e., toward a direction shown by the arrow) by a bubble generated in the bubble liquid.

A heat generating body 809 for preventing generation of a back-wave in the bubble liquid in the second liquid passage 804 comprises a heater (second heat generating element) for generating a bubble for cancelling the back-wave. Stepped portions defining a recess formed pattern-etching is disposed between the heater 809 and the heat generating element 802, and the heater 809 is provided on an inclined surface inclines toward the discharge opening 810.

In the illustrated embodiment, among the back-waves generated during the liquid discharging operation, the back-wave in the first discharge liquid passage 803 is cancelled by the displacement of the movable member 806 and the back-wave in the second bubble liquid passage 804 is cancelled by the bubble generated by the heater 809.

It was found that the sufficient back-wave preventing effect could be obtained by generating the bubble by heating the heater 809 at a predetermined timing relating to the liquid discharging performed by the heat generating element 802. Further, since the recess is disposed between the heater 809 and the heat generating element 802, the re-fill of the bubble liquid can be performed effectively by the bubble liquid stored in the recess.

Incidentally, the discharge liquid supplied to the first liquid passages and the bubble liquid supplied to the second liquid passages are supplied from the common liquid chambers 811, 812, respectively. The discharge liquid may be the same as the bubble liquid. In this case, a single common liquid chamber may be provided.

Next, a fifth embodiment of the present invention will be explained.

In this fifth embodiment, a space (cross-hatched in FIG. 10) forwardly of the heat generating element 802 in the second liquid passage 804 is eliminated to prevent forward power loss in the second liquid passage. With this arrangement, the discharging efficiency is further improved and a higher quality image can be obtained.

Incidentally, in the fourth and fifth embodiments, while the head of edge chute type was explained as is in the first embodiment, it should be noted that the fourth and fifth embodiments can be applied to heads of side chute type as is in the second and third embodiments.

In the embodiments in which the liquid discharging operation is effected by generating the bubble as mentioned above, it is important that the bubble does not remain in the discharge nozzle after the liquid discharging. If a part of the bubble remains in the bubble generating area, the formation of the bubble becomes unstable, resulting in the unstable liquid discharging. On the other hand, if the bubble remains in the discharge area, the discharged liquid becomes uneven, thereby preventing the stable recording. In the second and third embodiments shown in FIGS. 6A to 6D, 7E to 7G, 8A to 8D and FIGS. 9E to 9G, although the trapping of the liquid is avoided by providing the tapered end surface, the trapping of the bubble can also be avoided by appropriately selecting a driving condition of the heat generating element. Such a driving condition may be to slightly shift the movable member in order to stabilize the state of the liquid around the movable member (particularly, below the movable member) after the liquid discharging. By combining such a driving condition with the normal driving condition, the stable liquid discharging can be achieved.

When it is assumed that the normal driving condition for discharging the liquid is a drive condition A and the driving condition for slightly shifting the movable member in order to stabilize the state of the liquid around the movable member after the liquid discharging is a drive condition B, the discharging method according to the present invention will be explained.

Figure 11:
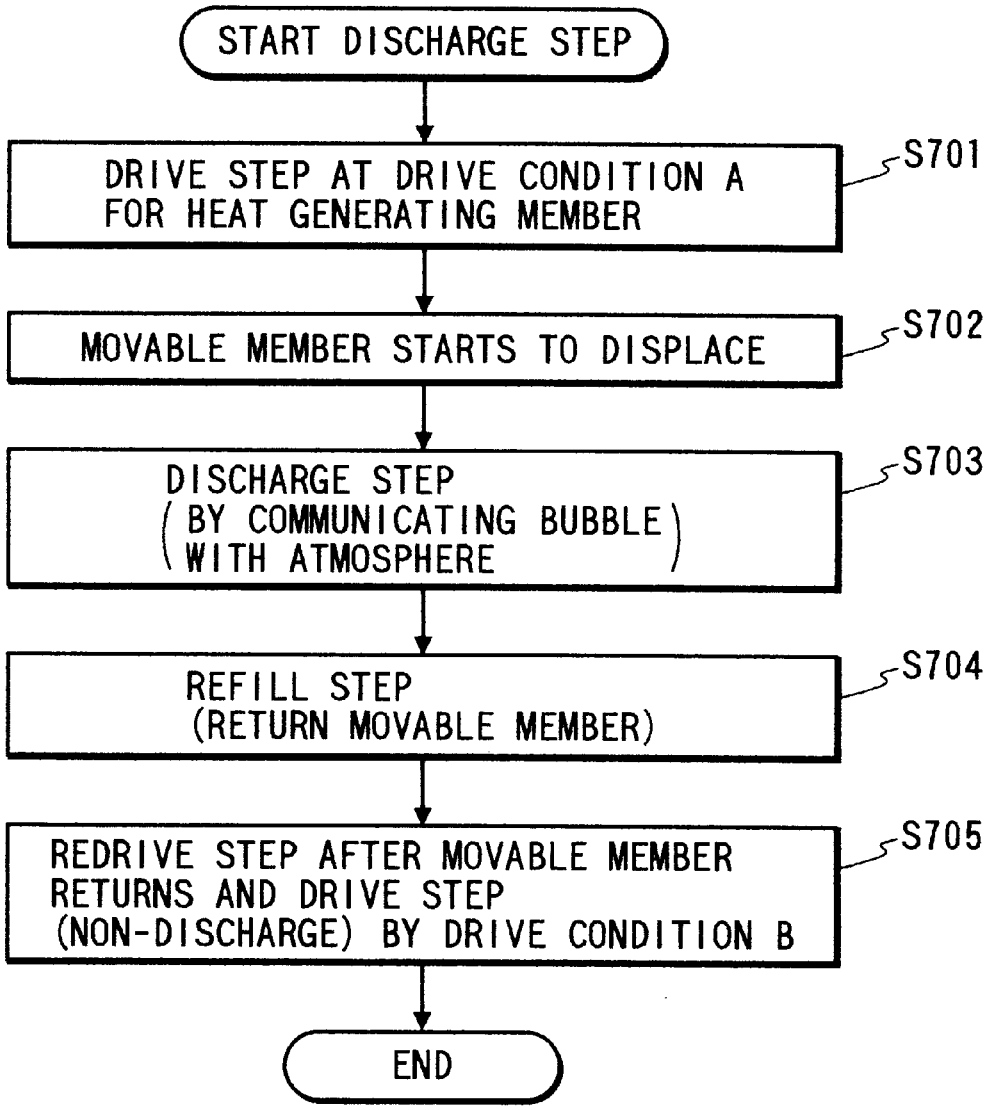
FIG. 11 is a flow chart showing a discharging method according to the present invention.

FIG. 11 is a flow chart showing the discharging method using the above combination of the drive conditions. When the discharging operation is effected (discharge step is started), first of all, the driving is effected under the drive condition A (step S701). As a result, as already explained with respect to the above embodiments, the movable member is displaced (step S702), the liquid discharging is effected under the condition that the bubble is communicated with the atmosphere (step S703), and the re-fill is performed (step S704). Thereafter, the driving is effected under the drive condition B, thereby discharging the undesired bubble in the liquid (step S705). Then, the discharge step is ended.

By performing the above steps as a series of successive operations during the liquid discharging, the trapping of the bubble in the liquid can be prevented and the good recording can be effected.

Figure 21:
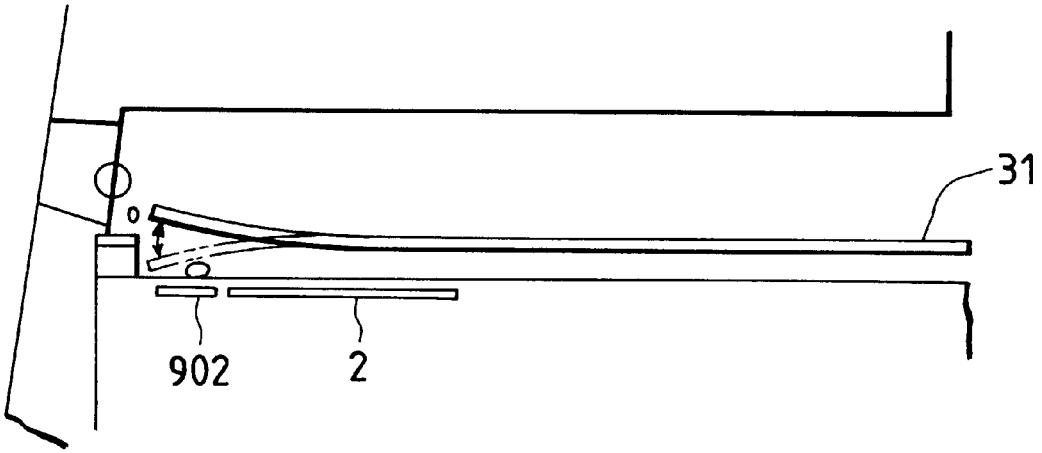
FIG. 21 is a sectional view showing an alteration of the liquid discharging head in which a residual bubble remaining in a bubble generating area can easily be discharged.
Figure 22A:
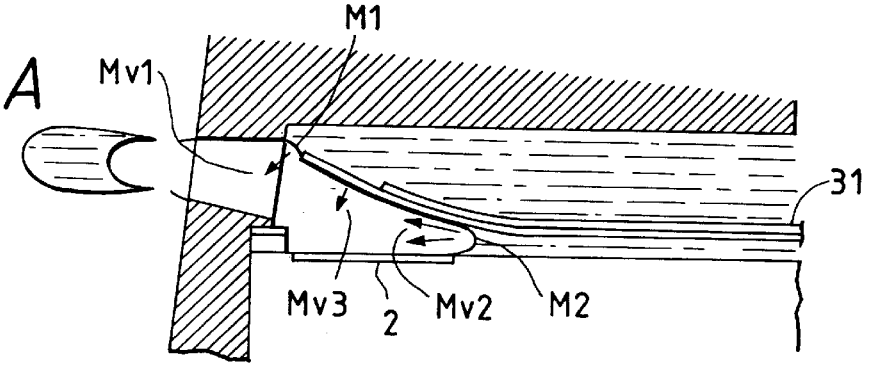
FIGS. 22A, 22B, 22C and 22D are explanatory views showing another alteration in which the residual bubble remaining in the bubble generating area can easily be discharged.
Figure 22B:
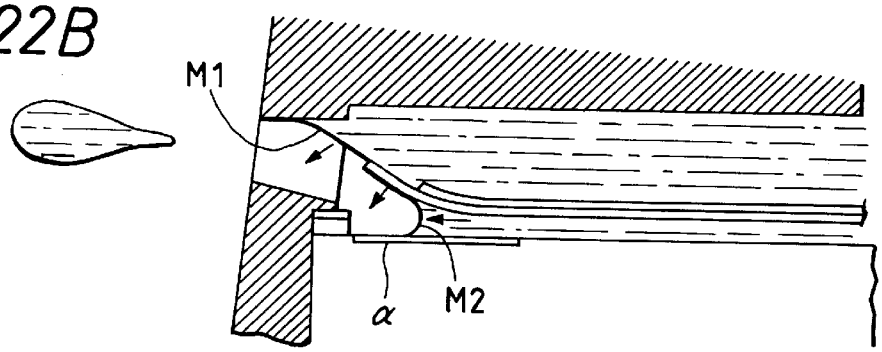
Figure 22C:
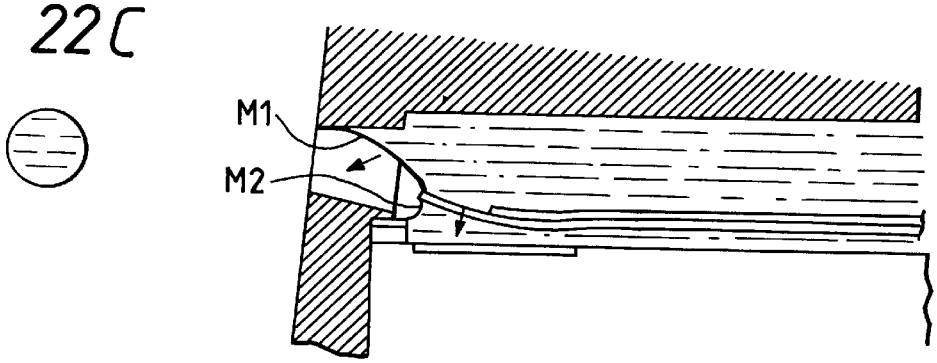
Figure 22D:
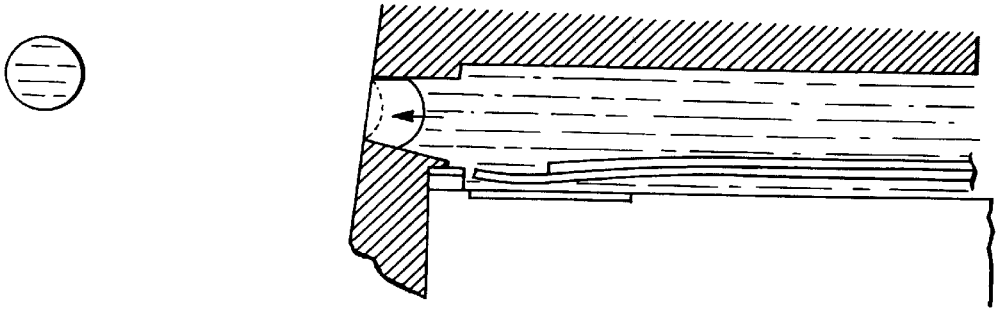

Alternatively, as shown in FIG. 21, a small heater (second heat generating element) 902 for generating a bubble not contributing to the liquid discharging may be disposed at a downstream side of the heat generating element 2, and, by repeating generation and disappearance of the bubble not contributing to the liquid discharging, the movable member may be vibrated to discharge the residual bubble from the bubble generating area by a check valve effect.

Further, by providing two movable members so that a free end of the upper movable member is disposed at an upstream side of a free end of the lower movable member, as shown in FIGS. 22A to 22D, the returning of the movable member 31 may be promoted from the fulcrum side of the movable member 31 to advance the meniscus toward the downstream side by the movable member 31, with the result that the re-fill of the bubble liquid is effected faster, thereby discharging the residual bubble from the bubble generating area.

Incidentally, in FIGS. 22A to 22D, while two movable members were shown, a single movable member having a free end thinner than a fulcrum may be used.

<Head of Two-liquid Passage Type>

Now, a liquid discharging head in which different liquids can be introduced into first and second common liquid chambers with good isolation, the number of parts can be reduced and can achieve "cost-down" will be explained.

Figure 12:
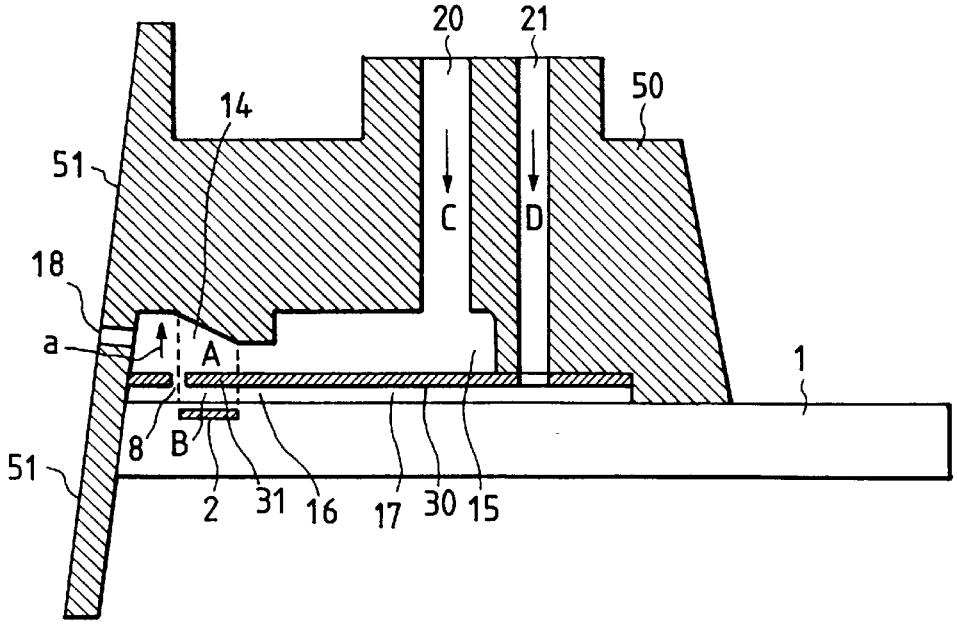
FIG. 12 is a sectional view for explaining liquid supply passages of a liquid discharging head according to the present invention.

FIG. 12 is a schematic sectional view showing a liquid discharging head of edge chute type. Since the fundamental construction for effecting the liquid discharging is the same as that of the first embodiment, the same elements as these in the first embodiment are designated by the same reference numerals and detailed explanation thereof will be omitted.

In the illustrated embodiment, a grooved member 50 includes an orifice plate 51 having discharge openings 18, a plurality of grooves constituting a plurality of first liquid passages 14, and a recess communicated with the plurality of liquid passages 14 and adapted to define a first common liquid chamber 15 for supplying liquid (discharge liquid) to the first liquid passages 14.

By joining a separation wall 30 to a lower portion of the grooved member 50, the plurality of first liquid passages 14 can be formed. The grooved member 50 has a first liquid supply passage 20 extending into a first common liquid chamber 15 from the above. Further, the grooved member 50 has a second liquid supply passage 21 extending into a second common liquid chamber 17 from the above through a separation wall 30.

As shown by the arrow C in FIG. 12, the first liquid (discharge liquid) is supplied to the first liquid passage 14 through the first liquid supply passage 20 and the first common liquid chamber 15, and, as shown by the arrow D in FIG. 12, the second liquid (bubble liquid) is supplied to the second liquid passage 16 through the second liquid supply passage 21 and the second common liquid chamber 17.

In the illustrated embodiment, while an example that the second liquid supply passage 21 extends in parallel with the first liquid supply passage 20 was shown, the present invention is not limited to such an example, but, any arrangement of the second liquid supply passage may be adopted so long as it extends into the second common liquid chamber 17 through the separation wall 30 disposed outside of the first common liquid chamber 15.

Further, a magnitude (diameter) of the second liquid supply passage 21 is determined in consideration of the supply amount of the second liquid. The cross-sectional shape of the second liquid supply passage 21 is not limited to a circular shape, but may be rectangular.

Figure 13:
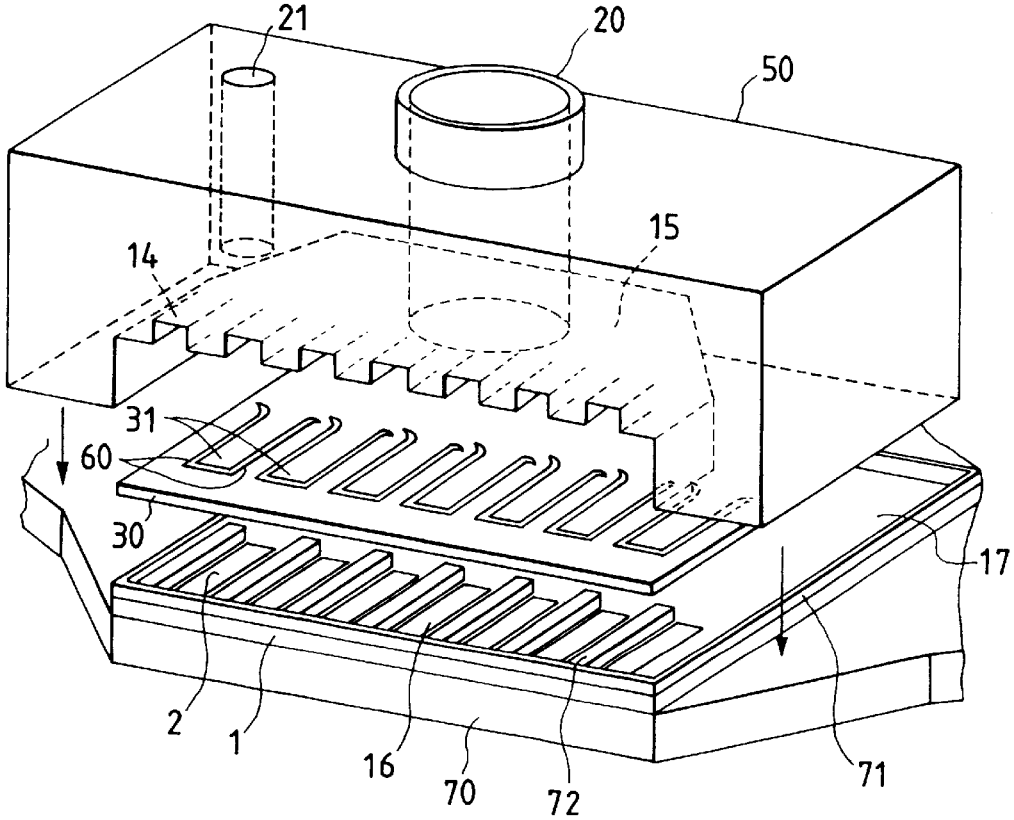
FIG. 13 is an exploded perspective view of the head according to the present invention.

The second common liquid chamber 17 can be formed by partitioning the grooved member 50 by the separation wall 30. As an example, as shown in FIG. 13 (exploded perspective view), the second common liquid chamber 17 and the second liquid passage 16 can be formed by forming a common liquid chamber frame 71 and second liquid passage walls 72 on the substrate 1 and then by joining an assembly of the separation wall 30 and the grooved member 50 to the substrate 1.

In the illustrated embodiment, the substrate 1 on which the plurality of electrical/thermal converters (heat generating elements) for generating the heat for forming the bubble in the bubble liquid by the film-boiling are arranged is disposed on a support 70 made of metal such as aluminum.

On the substrate 1, there are provided a plurality of grooves for constituting the second liquid passages 16 defined by the second liquid passage walls 72, a recessed portion constituting the second common liquid chamber (common bubble liquid chamber) 17 communicated with the plurality of discharge liquid passages and adapted to supply the bubble liquid to the discharge liquid passages, and the separation wall 30 including the movable members 31.

The grooved member 50 includes the grooves for constituting the discharge liquid passages (first liquid passages) 14 by combining with the separation wall 30, a recessed portion for constituting the first common liquid chamber (common discharge liquid chamber) 15 communicated with the discharge liquid passages and adapted to supply the discharge liquid to the discharge liquid passages, the first liquid supply passage (discharge liquid supply passage) 20 for supplying the discharge liquid to the first common liquid chamber 15, and the second liquid supply passage (bubble liquid supply passage) 21 for supplying the bubble liquid to the second common liquid chamber 17. The second liquid supply passage 21 is connected to a communication passage extending into the second common liquid chamber 17 through the separation wall 30 disposed outside of the first common liquid chamber 15, and, by this supplied to the second common liquid chamber 17 without mixing with the discharge liquid.

Regarding the positional relation between the substrate 1, the separation wall 30 and the grooved member 50, the movable members 31 are disposed in correspondence to the heat generating elements 2 of the substrate 1, and the discharge liquid passages 14 are arranged in correspondence to the movable members 31. Further, in the illustrated embodiment, while an example that the single second liquid supply passage 21 is formed in the grooved member 50 was explained, a plurality of second liquid supply passages may be provided in accordance with the liquid supply amount. In addition, flow areas of the first and second liquid supply passages 20, 21 may be determined in proportion to the liquid supply amount. By optimizing the flow areas in this way, the parts constituting the grooved member 50 and the like can be made compact.

As mentioned above, according to this embodiment, since the second liquid supply passage 21 for supplying the second liquid to the second liquid passages 16 and the first liquid supply passage 20 for supplying the first liquid to the first liquid passages 14 are formed in the same grooved member (grooved top plate), the number of parts can be reduced, the number of manufacturing steps can be reduced and the "cost-down" can be achieved.

Further, since the supply of the second liquid to the second common liquid chamber communicated with the second liquid passages 16 is effected by the second liquid supply passage extending through the separation wall for isolating the first and second liquids from each other, the assembling between the separation wall, grooved member and substrate can be performed by a single step, thereby facilitating the manufacture, improving the assembling accuracy and achieving the good liquid discharging.

Further, since the second liquid is supplied to the second common liquid chamber through the separation wall, the supply of the second liquid to the second liquid passages is effected positively, and, thus, since the adequate liquid supply amount is ensured, the stable liquid discharging can be achieved.

<Discharge Liquid and Bubble Liquid>

As mentioned above, in the present invention, since the head has the above-mentioned movable members, the liquid can be discharged at high speed with higher discharging force and higher discharging efficiency than those in the conventional heads. When the same liquid is used as both bubble liquid and discharge liquid, various kinds of liquids can be used so long as the liquid is not deteriorated by the heat from the heat generating element, deposit from the liquid due to the heat is hard to be accumulated on the heat generating element, the reversible state change between evaporation and condensation due to heat can be permitted and the deterioration of liquid passage walls, movable members and separation wall can be prevented.

Among such liquids, as the recording liquid, ink having conventional composition utilized in the conventional bubble jet apparatuses can be used.

On the other hand, when the head of two-passage type is used and the discharge liquid is different from the bubble liquid, as the bubble liquid, the liquids having the above-mentioned features may be used. More specifically, the following liquids may be used: methanol, ethanol, n-propanol, isopropanol, n-hexane, n-heptane, n-octane, toluene, xylene, methylene dichloride, trichlene, fleon TF, fleon BF, ethylether, dioxane, cyclohexane, methyl acetate, ethyl acetate, acetone, methylethylketone, water and their compounds.

Regarding the discharge liquid, various kinds of liquids can be used regardless of bubbling ability and thermal features. Even liquid having low bubbling ability, liquid easy to be deteriorated by heat and high viscous liquid (which were hard to be discharged by the conventional techniques) can be used.

However, if the liquid discharging, formation of the bubble and/or operation of the movable member are prevented by the feature of the discharge liquid and the reaction between the discharge liquid and the bubble liquid, such discharge liquid should not be used.

Regarding the recording discharge liquid, high viscous ink can be used. Further, medical liquids and scented water having poor resistance to heat can also be used as the discharge liquid.

In the present invention, as the recording liquid used as both the discharge liquid and the bubble liquid, ink having the following composition was used. As a result, since the discharging speed of ink was increased by enhancement of the discharging force, target accuracy of ink droplet was improved and a high quality image could be obtained.

| | | |
|---|---|---|
| dye ink (viscosity 2 cp) | (C.I. food black 2) dye | 3 wt % |
| | diethylene glycol | 10 wt % |
| | thiodiglycol | 5 wt % |
| | ethanol | 3 wt % |
| | water | 77 wt % |

Further, liquid having the following composition was combined with the bubble liquid and the discharge liquid and the recording was performed. As a result, not only liquid having viscosity of ten-odd cps (which was hard to be discharged in the conventional techniques) but also high viscous liquid having viscosity of 150 cps could be discharged effectively and high quality image could be obtained.

| | | |
|---|---|---|
| bubble liquid 1 | ethanol | 40 wt % |
| | water | 60 wt % |
| bubble liquid 2 | water | 100 wt % |
| bubble liquid 3 | isopropyl alcohol | 40 wt % |
| | water | 60 wt % |
| discharge liquid 1 [dye ink (viscosity about 15 cp)] | carbon black | 5 wt % |
| | stylene-acrylic acid-acrylic acid ester copolymer (oxidation 140 weight average molecular weight 8000) | 1 wt % |
| | monoethanol amine | 0.25 wt % |
| | glycerol | 69 wt % |
| | chiodiglycol | 5 wt % |
| | ethanol | 3 wt % |
| | water | 16.75 wt % |
| discharge liquid 2 (viscosity 55 cp) | polyethylene glycol 200 | 100 wt % |
| discharge liquid 3 (viscosity 150 cp) | polyethylene glycol 600 | 100 wt % |

By the way, in case of the above-mentioned liquid which has conventionally been considered to be hard to discharge, since the discharging speed is small, unevenness in discharging direction was worsened and the target accuracy of ink dot was also worsened and there arose unevenness in discharge amount due to unstable discharging, which resulted in poor image. However, in the illustrated embodiment, by using the bubble liquid, the bubble can be generated stably and adequately. Thus, the target accuracy of the liquid droplet can be improved and the ink discharge amount can be stabilized, thereby improving the image quality greatly.

<Manufacture of Liquid Discharging Head>

Next, a method for manufacturing the liquid discharging head according to the present invention will be explained.

In case of the liquid discharging head as shown in FIG. 1, the bases 34 for attaching the movable member 31 to the substrate 1 are formed by patterning dry film and the like, and the movable member 31 is bonded or welded to the bases 34. Thereafter, the grooved member having the plurality of grooves constituting the liquid passages 10, the discharge openings 18, and the recessed portion constituting the common liquid chamber 13 is joined to the substrate 1 in such a manner that the grooves are opposed to the movable member 31.

Next, a method for manufacturing the liquid discharging head of two-passage type as shown in FIG. 12 will be explained.

Briefly explaining, the walls for the second liquid passages 16 are formed on the substrate 1, and the separation wall 30 is attached onto the substrate, and then, the grooved member 50 having the grooves constituting the first liquid passages 14 and the like is attached thereto. Alternatively, after the walls for the second liquid passages 16 were formed, the grooved member 50 to which the separation wall 30 was attached is joined to the walls.

Now, a method for manufacturing the second liquid passages will be fully explained.

FIGS. 14A to 14E are schematic sectional views for explaining a first embodiment of a method for manufacturing the liquid discharging head of the present invention.

Figure 14A:
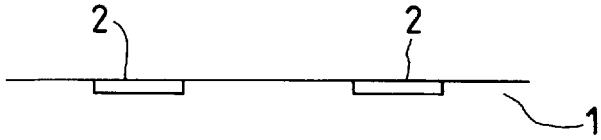
FIGS. 14A, 14B, 14C, 14D and 14E are views for explaining a method for manufacturing the liquid discharging head according to the present invention.

In this embodiment, as shown in FIG. 14A, after the electrical/thermal converters having the heat generating elements 2 made of hafnium boride or tantalum nitride are formed on the substrate (silicone wafer) 1 by using the same manufacturing apparatus as that used in the semiconductor manufacturing process, the surface of the substrate 1 is cleaned in order to improve close contact ability between the substrate and photosensitive resin in a next process or step. Further, in order to improve the close contact ability, it is desirable that, after the surface of the substrate 1 is illuminated by ultraviolet ray/ozone, for example, liquid obtained by diluting silane coupling agent (A189 available from Nippon Unica Co., Ltd.) with etylalcohol up to 1 wt % is spin-coated on the treated surface.

Figure 14B:
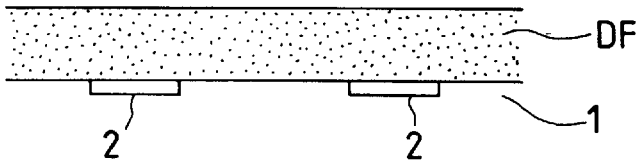

Then, after the surface cleaning is effected, as shown in FIG. 14B, ultraviolet-sensitive resin film DF ("Dry Film Odel SY-318" (trade mark); available from Tokyo Ohka Co., Ltd.) is laminated on the substrate 1 (close contact ability of the surface of which was improved).

Figure 14C:
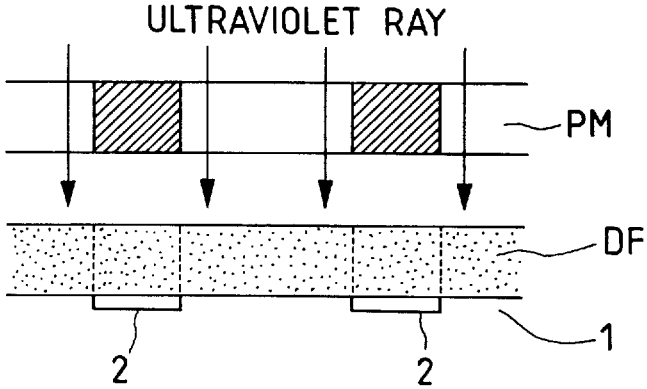

Then, as shown in FIG. 14C, a photo mask PM is disposed on the dry film DF, and, ultraviolet ray is illuminated onto a portion of the dry film DF which is to be remained as the second liquid passage walls through the photomask PM. This exposure process is effected by using the apparatus (MPA-600 available from Canon K.K., in Japan) with an exposure amount of about 600 mJ/cm$^2$.

Figure 14D:
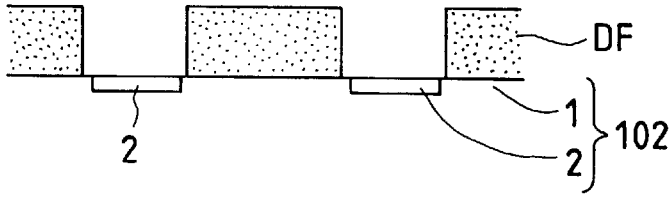

Then, as shown in FIG. 14D, the dry film DF is developed by a developing liquid (BMRC-3 available from Tokyo Ohka Co., Ltd.) comprised of mixture liquid of xylene and butyl selsolve acetate to dissolve the non-exposed portion, thereby forming the hardened portions as the wall portions of the second liquid passages 16. Further, the residual matters remaining on the surface of the substrate 1 are removed by driving an oxide plasma ashing apparatus (MAS-800 available from Alcantec Inc.) for about 90 seconds. Then, the ultraviolet ray is further illuminated with the exposure amount of 100 mJ/cm$^2$ at a temperature of 150° C. for two hours, thereby completely hardening the exposed portions.

A plurality of heater boards (substrates) obtained by dividing so treated silicone wafer have high accurate second liquid passages 16. The silicone wafer were divided into the heater boards by a dicing machine (AWD-4000 available from Tokyo Seimitsu Co., Ltd.) including a diamond blade having a thickness of 0.05 mm. The divided or separated heater board 1 is secured to an aluminum base plate (support) 70 (FIG. 17) by an adhesive (SE4400 available from Toray Co., Ltd.). Then, a printed wiring board 71 previously connected to the aluminum base plate 70 is connected to the heater board 1 via aluminum wires (not shown) having a diameter of 0.005 mm.

Figure 14E:
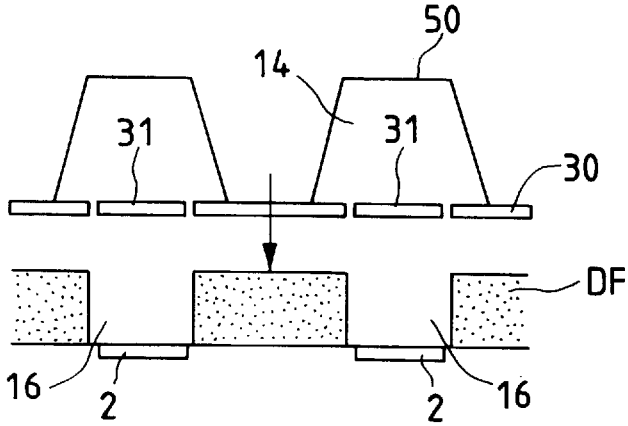

Then, as shown in FIG. 14E, the assembly of the grooved member 50 and the separation wall 30 is positioned on and joined to the heater board 1. That is to say, the grooved member 50 including the separation wall 30 and the heater board 1 are positioned and secured to each other by a cap spring 78, and, then, an ink/bubble liquid supplying member 80 is securely joined to the aluminum base plate 70 with the interposition of the assembly of the grooved member and the separation wall. Then, gaps between the aluminum wires and between the grooved member 50, the heater board 1 and the ink/bubble liquid supplying member 80 are filled with and sealed by silicone sealant (TSE399 available from Toshiba Silicone Co., Ltd.), thereby completing the head.

By forming the second liquid passages in this way, high accurate liquid passages having no positional deviation with respect to the heat generating elements of the heater board can be obtained. Particularly, by previously assembling the grooved member 50 and the separation wall 30 together in the previous step, the positional accuracy of the first liquid passages 14 and the movable members 31 can be enhanced.

By using such high accurate manufacturing methods, the discharging feature can be stabilized and the image quality can be improved. Further, since the substrates can be formed on the wafer collectively, mass-production can be permitted, thereby achieving the "cost-down".

Incidentally, in the illustrated embodiment, while an example that the dry film of type which can be cured by the ultraviolet ray is used to form the second liquid passages was explained, resin having ultraviolet band (particularly, absorption band near 248 nm) may be used, and, after lamination, resin may be cured and then portions corresponding to the second liquid passages 16 may be directly removed by excimer laser.

FIGS. 15A to 15D are schematic sectional views showing a second embodiment of a method for manufacturing the liquid discharging head of the present invention.

Figure 15A:
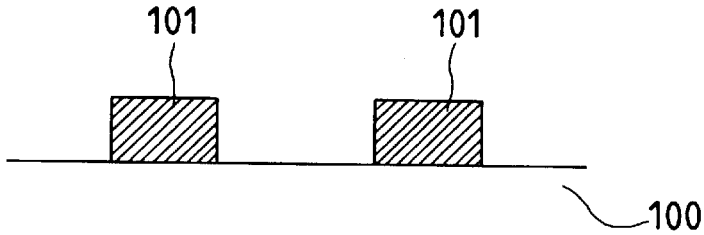
FIGS. 15A, 15B, 15C and 15D are views for explaining another method for manufacturing the liquid discharging head according to the present invention.

In this embodiment, as shown in FIG. 15A, regist 101 having a thickness of 15 $\mu$m is patterned on a SUS substrate plate 100 in correspondence to the shape of the second liquid passages.

Figure 15B:
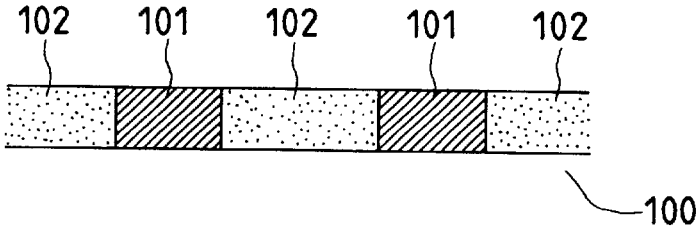

Then, as shown in FIG. 15B, the SUS substrate plate 100 is electro-plated to form a nickel layer 102 having a thickness of 15 $\mu$m on the SUS substrate plate 100. Regarding electro-plating liquid, sulfonic acid nickel, stress reduction agent ("Zeorol": trade mark; available from World Metal Inc.), boric acid, pit prevention agent (NP-APS available from World Metal Inc.) and nickel chloride are used. Regarding application of electric field upon electrodeposition, an electrode is attached to an anode and the patterned SUS substrate plate 1100 is attached to a cathode, and a temperature of the plating liquid is selected to 50° C. and current density is selected to 5 A/cm$^2$.

Figure 15C:
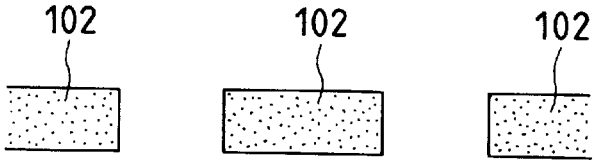

Then, as shown in FIG. 15C, after the electro-plating is finished, the SUS substrate plate 100 is subjected to ultrasonic vibration, so that the nickel layer 102 is peeled from the SUS substrate plate 100, thereby obtaining desired second liquid passages.

Figure 15D:
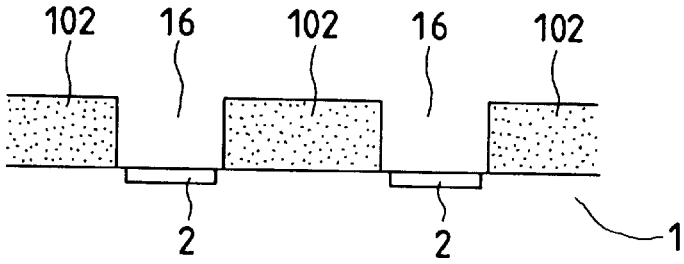

On the other hand, a plurality of heater boards having the electrical/thermal converters are formed on a silicone wafer by the same apparatus used in the semi-conductor process. Then, as is in the first embodiment, the silicon wafer is divided into the heater boards by the dicing machine. The divided or separated heater board 1 is secured to an aluminum base plate 70 to which a printed wiring board 71 was previously connected, and the printed wiring board 71 is connected to aluminum wires (not shown), thereby completing electrical connection. As shown in FIG. 15D, the second liquid passages 16 obtained by the previous step are positioned on and secured to the heater board 1. Regarding such securing, as is in the first embodiment, since the second liquid passages are securely joined by the top plate having the separation wall and the cap spring, the securing may be effected to the extent that positional deviation does not occur during the joining of the top plate.

In this embodiment, the securing is effected by using adhesive (Amicon UV-300 available from Glace Japan Co., Ltd.) of type which can be cured by the ultraviolet ray and an ultraviolet ray illuminating apparatus and by illuminating with the exposure amount of 100 mJ/cm$^2$ for about 3 seconds.

According to the illustrated method, the high accurate second liquid passages 16 having no positional deviation with respect to the heat generating elements can be obtained, and, since the liquid passage walls are formed from nickel, a high reliable head having good resistance to alkaline liquid can be obtained.

FIGS. 16A to 16D are schematic sectional views showing a third embodiment of a method for manufacturing the liquid discharging head of the present invention.

Figure 16A:
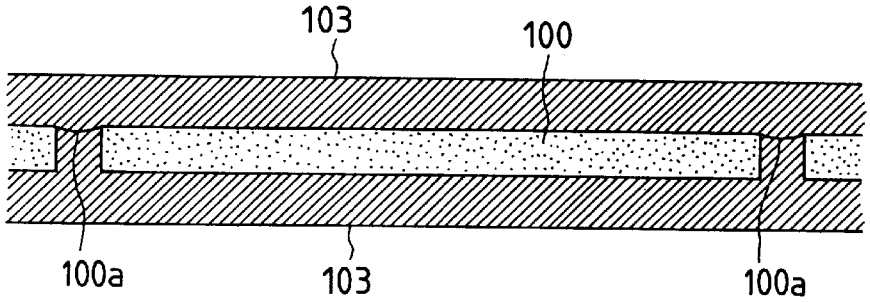
FIGS. 16A, 16B, 16C and 16D are views for explaining a further method for manufacturing the liquid discharging head according to the present invention.

In this embodiment, as shown in FIG. 16A, regists 103 are coated on both surfaces of a SUS substrate plate 100 having a thickness of 15 $\mu$m and having alignment holes 100*a* or marks. As the regist, PMERP-AR900 available from Tokyo Ohka Co., Ltd. is used.

Figure 16B:
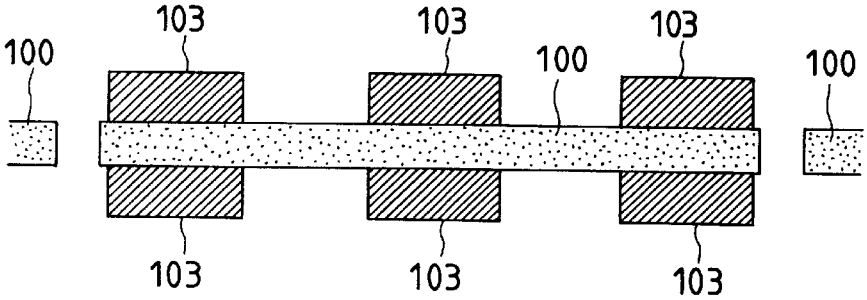

Thereafter, as shown in FIG. 16B, the exposure is effected in coincidence with the alignment holes 100*a* of the substrate plate 100 by using an exposure apparatus (MPA-600 available from Canon K.K., in Japan) to remove the regist 103 from portions where the second liquid passages are to be formed. The exposure is effected with the exposure amount of 800 mJ/cm$^2$.

Figure 16C:
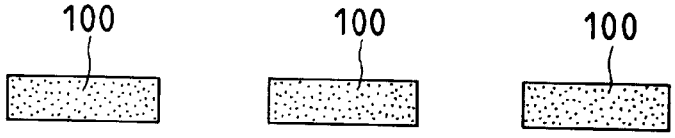

Then, as shown in FIG. 16C, the SUS substrate plate 100 having the patterned regist 103 at on both surface is dipped into etching liquid (solution of iron (III) chloride or copper (II) chloride), thereby etching portions exposed from the regist 103. Thereafter, the regist is peeled.

Figure 16D:
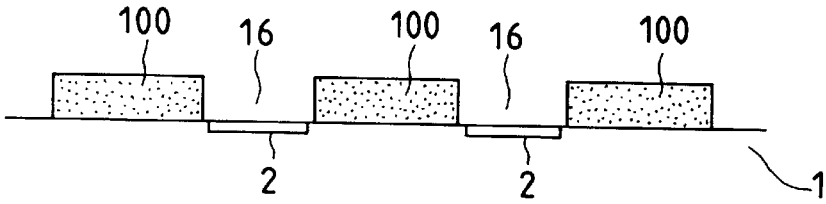

Then, as shown in FIG. 16D, as is in the former embodiment of the method, the etched SUS substrate plate 100 is positioned on and secured to the heater board 1, thereby assembling the liquid discharging head having the second liquid passages 16.

According to the illustrated method, the high accurate second liquid passages 16 having no positional deviation with respect to the heaters can be obtained, and, since the liquid passage walls are formed from SUS, a high reliable head having good resistance to alkaline liquid can be obtained.

As mentioned above, according to the illustrated method, by previously arranging the walls for the second liquid passages on the substrate, the electrical/thermal converters and the second liquid passages can be positioned relative to each other with high accuracy. Further, since the second liquid passages can be simultaneously formed on a plurality of substrates before division, a number of liquid discharging heads can be obtained with low cost.

Further, in the liquid discharging head obtained by the illustrated method, since the heat generating elements and the second liquid passages can be positioned relative to each other with high accuracy, the pressure of the bubble generated by the heat from the heat generating element can receive efficiently, thereby improving the discharging efficiency.

<Liquid Discharging Head Cartridge>

Next, a liquid discharging head cartridge including the above-mentioned liquid discharging head will be briefly explained.

Figure 17:
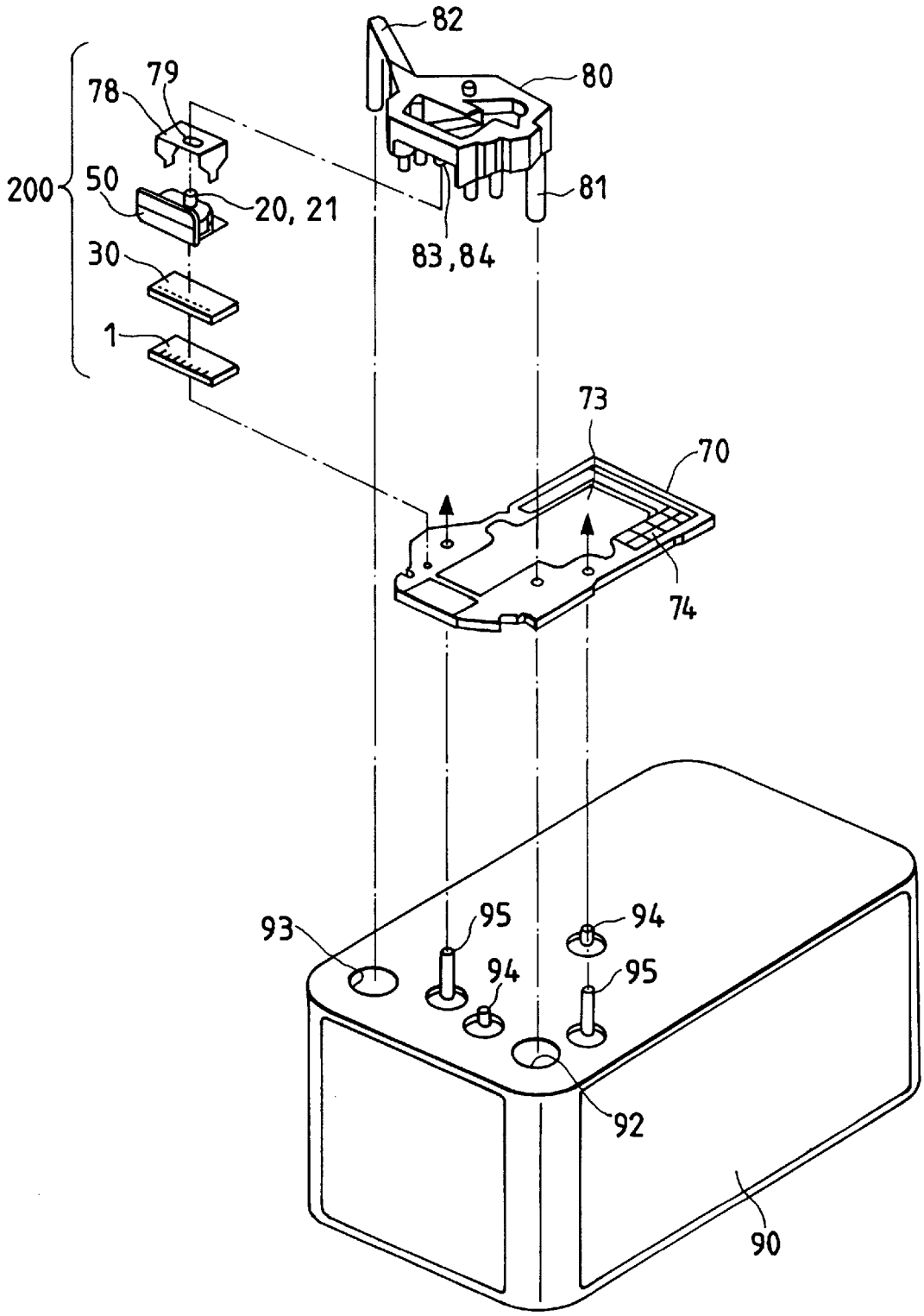
FIG. 17 is an exploded perspective view of a liquid discharging head cartridge.

FIG. 17 is a schematic exploded perspective view of a liquid discharging head cartridge including the above-mentioned liquid discharging head. The liquid discharging head cartridge mainly comprises a liquid discharging head portion 200 and a liquid container 90. The liquid discharging head portion 200 includes the substrate 1, separation wall 30, grooved member 50, cap spring 78, liquid supplying member 80 and support 70. The substrate 1 includes a plurality of side-by-side arranged heat generating resistance bodies for applying the heat to the bubble liquid, and a plurality of function elements for selectively driving the heat generating resistance bodies. The bubble liquid passages are formed between the substrate 1 and the separation wall 30 having the movable walls, and the bubble liquid flow through these liquid passages. By joining the grooved top plate 50 to the separation wall 30, the discharge liquid passages (not shown) are formed, and the discharge liquid flows these discharge liquid passages.

The cap spring 78 serves to apply a biasing force directing toward the substrate 1 to the grooved member 50. By such a biasing force, the substrate 1, separation wall 30 and grooved member 50 are effectively integrated with the support 70 which will be described later.

The support 70 serves to support the substrate 1, and, on the support 70, there are disposed a printed wiring board 71 connected to the substrate 1 and adapted to supply an electrical signal, and contact pads 72 for connection to the liquid discharging apparatus to perform communication between the cartridge and the apparatus.

The liquid container 90 serves to independently contain the discharge liquid such as ink and the bubble liquid for generating the bubble. Positioning portions 94 for attaching a connection member for connecting the liquid container to the liquid discharging head portion, and securing shafts 95 for securing the connection member are disposed on an outer surface of the liquid container 90. The discharge liquid is supplied from a discharge liquid supply passage 92 of the liquid container 90 to a discharge liquid supply passage 81 of the supplying member 80 through a supply passage 84 of the connection member and then is supplied to the first common liquid chamber through liquid supply passages 83, 71, 21 of the members. Similarly, the bubble liquid is supplied from a bubble liquid supply passage 93 of the liquid container 90 to a bubble liquid supply passage 82 of the supplying member 80 through a supply passage of the connection member and then is supplied to the second liquid chamber through liquid supply passages 84, 71, 21 of the members.

In the above-mentioned liquid discharging head cartridge, while the supply system and the liquid container which can perform the liquid supply even when the bubble liquid is different from the discharge liquid were explained, when the discharge liquid and the bubble liquid are the same, the supply path for the bubble liquid may not be separated from the supply path for the discharge liquid, and the liquid container may contain the single liquid.

Incidentally, after the liquid(s) from the liquid container is used up or consumed, new liquid may be replenished. To this end, liquid pouring port(s) may be provided in the liquid container. Further, the liquid container may be integrally formed with the liquid discharging head portion or may removably be mounted on the liquid discharging head portion.

<Liquid Discharging Apparatus>

Figure 18:
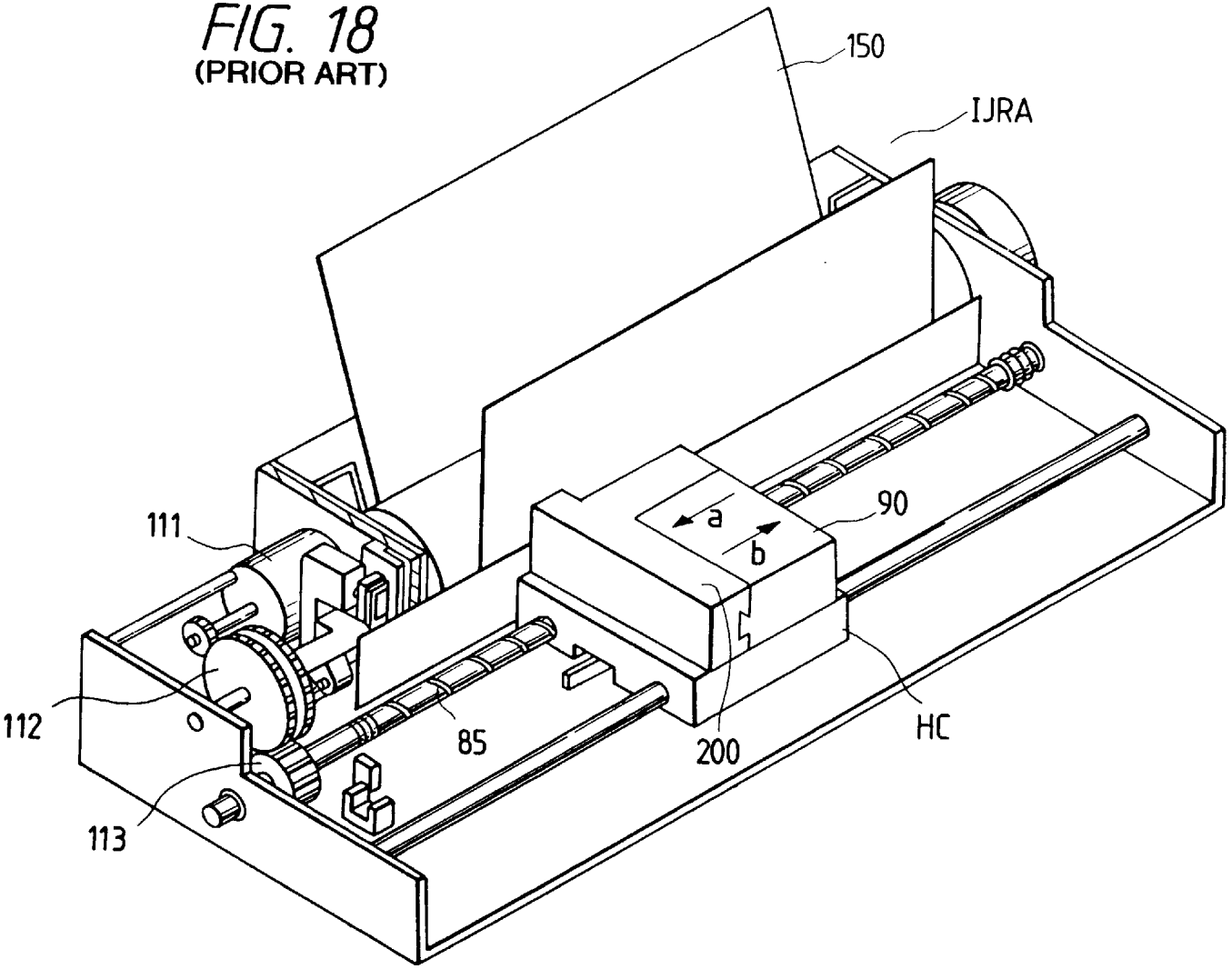
FIG. 18 (PRIOR ART)
FIG. 18 is a schematic perspective view of a liquid discharging apparatus.

FIG. 18 schematically shows a liquid discharging apparatus on which the above-mentioned liquid discharging head is mounted. In this example, particularly, an ink discharge recording apparatus IJRA using ink as the discharge liquid will be explained as the liquid discharging apparatus. The cartridge to which the liquid container 90 for containing the ink and the liquid discharging head portion 200 are removably attached is mounted on a carriage HC of the apparatus. The carriage can be reciprocally shifted in a width-wise direction (directions a, b) of a recording medium 150 conveyed by a recording medium convey means.

When a drive signal is supplied from a drive signal supplying means (not shown) to the liquid discharging means on the carriage, the recording liquid is discharged from the liquid discharging head portion toward the recording medium in response to the drive signal.

Further, in the liquid discharging apparatus according to the illustrated embodiment, there are provided a motor (drive source) 111 for driving the recording medium convey means and the carriage, gears 112, 113 for transmitting a driving force from the drive source to the carriage, and a carriage shaft 85. By discharging the liquid onto various kinds of recording media by using the recording apparatus and the liquid discharging method (effected in the recording apparatus), a good image can be recorded on the recording medium.

Figure 19:
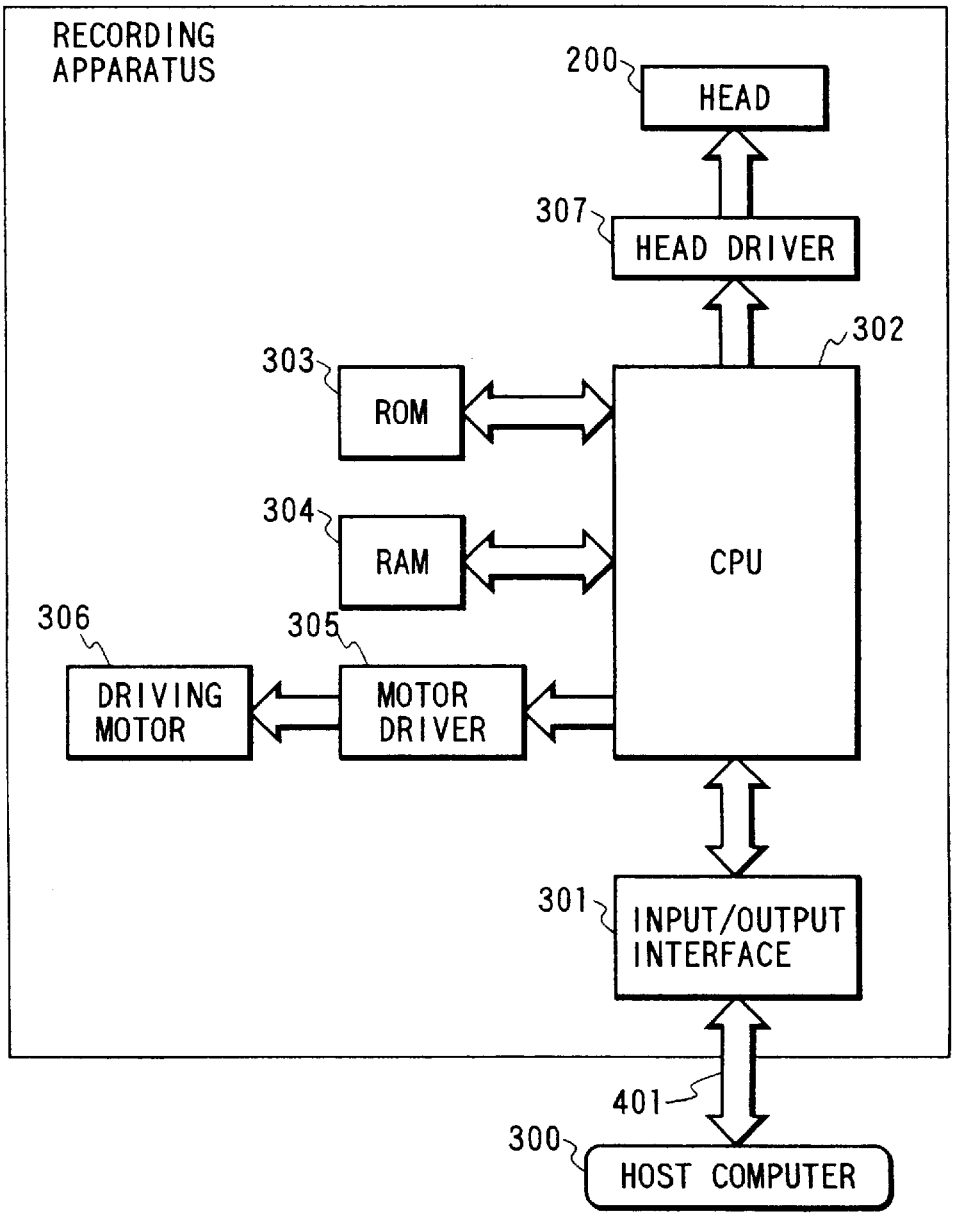
FIG. 19 (PRIOR ART)
FIG. 19 is a block diagram of the liquid discharging apparatus.

FIG. 19 is a block diagram of the entire of the apparatus for performing the ink discharge recording by using the liquid discharging head of the present invention.

In the recording apparatus, a host computer 300 receives recording information as a control signal. The recording information is temporarily stored in an input/output interface 301 of the apparatus and, at the same time, is converted into a treatable data in the apparatus. The data is inputted to a CPU 302 also acting as the head drive signal supplying means. The CPU 302 treates the input data on the basis of control program stored in a ROM 303, by utilizing peripheral units such as a RAM 304, to convert the input data into print data (image data).

Further, the CPU 302 produces drive data for driving a drive motor 306 for shifting the recording medium and the head 200 in synchronous with the image data in order to record the image data on a proper position on the recording medium. The image data and the motor drive data are transmitted to the head 200 and the drive motor 306 through a head driver 307 and a motor driver 305, respectively, thereby driving the head and motor at a controlled timing to form an image.

The recording medium applicable to the above-mentioned recording apparatus and capable of receiving the liquid such as ink may be various kinds of paper sheets, an OHP sheet, a plastic plate used in a compact disc or an ornament plate, cloth, a metal sheet made of aluminum, copper or the like, leather, pigskin, synthetic leather, wood, a wood board, a bamboo sheet, a ceramic sheet such as a tile, or three-dimensional articles such as sponge.

Further, the recording apparatus may include a printer for effecting the recording on various kinds of paper sheets or an OPH sheet, a plastic recording apparatus for effecting the recording on plastic material such as a compact disc, a metal recording apparatus for effecting the recording on metal, a leather recording apparatus for effecting the recording on leather, a wood recording apparatus for effecting the recording on wood, a ceramic recording apparatus for effecting the recording on ceramic material, a recording apparatus for effecting the recording on a three-dimensional net article such as sponge, and a print apparatus for effecting the recording on cloth.

Further, the discharge liquid used in these liquid discharging apparatuses may be selected in accordance with the kind of a recording medium and a recording condition.

<Recording System>

Next, an example of an ink jet recording system in which the recording is effected on the recording medium by using the liquid discharging head of the present invention as a recording head will be explained.

Figure 20:
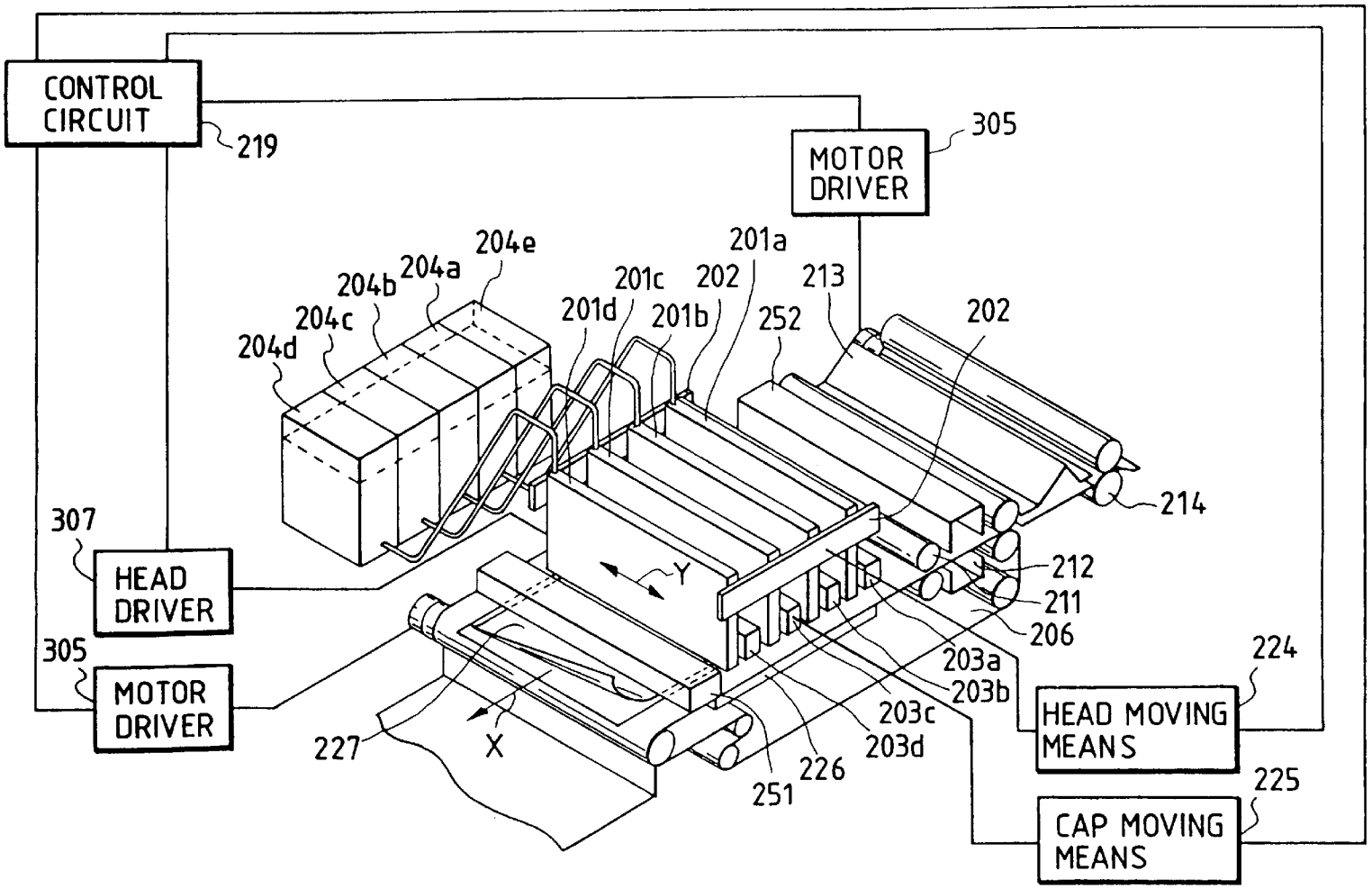
FIG. 20 (PRIOR ART)
FIG. 20 is a view showing a liquid discharge recording system.

FIG. 20 is a schematic view for explaining a construction of an ink jet recording system using the liquid discharging head 201 of the present invention. The liquid discharging head according to this embodiment is a head of full-line type in which a plurality of discharge openings are disposed at an interval of 360 dpi along the length of a maximum record allowable width of the recording medium 150, and four heads corresponding to yellow (Y) color, magenta (M) color, cyan (C) color and black (Bk) color, respectively, are fixedly held by a holder 202 at a predetermined interval in an X direction.

A signal is supplied from the head driver (drive signal supplying means) 307 to one of the heads, so that the head is driven in response to the signal.

Four color (Y, M, C, Bk) inks are supplied as the discharge liquids from ink containers 204*a*–204*d* to the heads, respectively. Incidentally, the reference numeral 204*e* denotes a bubble liquid container containing the bubble liquid, and the bubble liquid is supplied from the bubble liquid container to the heads.

Further, head caps 203*a*–203*d* including ink absorbing material such as sponge are disposed below the respective heads so that, in an inoperative condition, the heads is protected by covering the discharge openings of the heads by the head caps.

The reference numeral 206 denotes a convey belt constituting a convey means for conveying various kinds of recording medium, as mentioned above. The convey belt 206 is mounted on a plurality of rollers and is driven by a drive roller connected to the motor driver 305.

In the ink jet recording system according to the illustrated embodiment, there is provided a pre-treatment device 251 adapted to perform pre-treatment regarding the recording medium before the recording is started and disposed at an upstream side in a recording medium conveying path, and a post-treatment device 252 adapted to perform post-treatment regarding the recording medium after the recording is finished and disposed at a downstream side in the recording medium conveying path.

The pre-treatment and post-treatment are varied in accordance with the kind of the recording medium to be recorded and/or the kind of ink. For example, regarding the recording medium made of metal, plastic or ceramic, as the pre-treatment, ultraviolet ray and ozone are illuminated onto the recording medium to make a surface of the recording medium active, thereby improving the adhering ability of ink to the recording medium. Further, in case of the recording medium (for example, plastic) which easily generates static electricity, dirt is apt to be adhered to the surface of the recording medium due to the static electricity, resulting in prevention of good recording. Thus, such a recording medium, as the pre-treatment, the static electricity is removed from the recording medium by using an ionizer device to remove dirt on the recording medium. Further, when the cloth is used as the recording medium, in a view point of prevention of blot and improvement in coloring ability, as the pre-treatment, material selected among alkaline substance, water-soluble substance, synthetic polymer, water-soluble metal chloride, urea and chiourea may be added to the cloth. The pre-treatment is not limited above-mentioned examples, but, may include treatment for adjusting a temperature of the recording medium to a temperature suitable for the recording.

On the other hand, the post-treatment may include heat treatment of the recorded recording medium, fixing treatment for promoting the fixing of ink by illumination of ultraviolet ray and cleaning treatment for cleaning the residual treatment agent.

Incidentally, in the illustrated embodiment, while an example that the full line heads are used as the heads was explained, the present invention is not limited to such an example, the recording may be effected by shifting the above-mentioned compact head in the width-wise direction of the recording medium.

The characteristics of the present invention shown in the above-mentioned various embodiments are as follows:

(1) By providing the movable member, when the bubble is communicated with the atmosphere, the communication portion stably maintained between the discharged liquid and the liquid in the liquid passage to surely preventing the liquid passage from being blocked by the bubble, thereby achieving the stable liquid discharging.

(2) When the bubble is communicated with the atmosphere, it is desirable that the inner pressure of the bubble is substantially equal to or lower than the atmospheric pressure. Under such a condition, since the upward momentum of the liquid in the discharge opening is great, the meniscus becomes great. However, the growth of the meniscus is prevented by the presence of the movable member, thereby effecting the re-fill quickly.

(3) The growing direction of the bubble for generating the discharge energy can be controlled by the movable member, thereby increasing acceleration in the discharging direction.

(4) It is desirable that the inner pressure of the bubble is substantially equal to or lower than the atmospheric pressure. Such a bubble can be formed under the condition that the distance 1*a* between the end of the heat generating element nearer to the discharge opening and the end of the bubble nearer to the discharge opening and the distance 1*b* between the end of the heat generating element remote from the discharge opening and the end of the bubble remote from the discharge opening are selected to have a relation of $1a/1b \geqq 1$. In the present invention, since the growing direction of the bubble can be controlled by the movable member, the bubble satisfying the above condition can easily be formed.

Incidentally, in the above embodiments, while an example that the bubble is generated by the film-boiling was explained, in the present invention, a bubble generated by any boiling can be controlled, and, since the re-fill is improved by the communication between the positive pressure bubble and the atmosphere, the controlling of the bubble generated by any boiling is included within the scope of the present invention.

As mentioned above, in the present invention, the growing direction of the bubble can be concentrated toward the free end of the movable member by using the movable member, with the result that the distribution of the growth of the bubble with respect to the discharge opening can be made more uniform. Therefore, according to the present invention, unevenness between the discharged liquid droplets can be minimized and the liquid discharging direction can be made more uniform.

By adopting the movable member giving the above-mentioned various advantages to the liquid discharging head of atmosphere communication type, the liquid discharging efficiency, re-filling efficiency and liquid discharging stability (which could not be compatible in the conventional techniques) can be compatible with each other. As a result, at least one or all of the liquid discharging efficiency, re-filling efficiency and liquid discharging stability can be improved. Further, a high quality image can be obtained.

Further, high viscous liquids and liquids in which deposit can easily be formed (which were not used in the conventional heads) can be discharged efficiently, thereby obtaining the high quality image.

What is claimed is:

1. A method for discharging ink from a liquid jet head having a discharge port for discharging liquid and having a bubble forming mechanism and a moveable member having a free end which is displaceable in accordance with the growth of a bubble formed by said bubble forming mechanism, said method comprising the steps of:

forming a bubble in the liquid;

growing the bubble formed in the liquid;

directing, by means of said moveable member, the growth of the bubble toward the discharge port so that the bubble becomes communicated with external air at an area of said discharge port; and after the bubble has been communicated to the atmosphere, repelling the atmosphere out of said discharge port by means of said moveable member.

2. A method according to claim 1, wherein, when the bubble is communicated with the atmosphere, a liquid passage communicated with a liquid supply source to receive the liquid from said liquid supply source is not blocked by the bubble.

3. A method according to claim 1, wherein the bubble is communicated with the atmosphere in a condition that inner pressure of the bubble is lower than atmospheric pressure.

4. A method for discharging method according to any one of claims 1, 2 and 3, wherein a heat generating element is used for generating the bubble in the liquid, and the bubble generated in the liquid by said heat generating element is communicated with the atmosphere through said discharge opening under a condition that a distance 1*a* between an end of said heat generating element nearer to said discharge opening and an end of the bubble nearer to said discharge opening and a distance 1*b* between an end of said heat generating element remote from said discharge opening and an end of the bubble remote from said discharge opening are selected to have a relation of $1a/1b \geqq 1$.

5. A method for discharging method according to claim 1, wherein, in order to discharge the bubble in the liquid into the atmosphere after the bubble was communicated with the atmosphere, said movable member is displaced by generating a bubble not contributing to the liquid discharging.

6. A method for discharging ink from a liquid jet head having a discharge port for discharging liquid and having a bubble forming mechanism and a moveable member having a free end which is displaceable in accordance with the growth of a bubble formed by said bubble forming mechanism, said method comprising the steps of:

forming a bubble in the liquid;

growing the bubble formed in the liquid;

directing, by means of said moveable member, the growth of the bubble toward the discharge port so that the bubble becomes communicated with external air at an area of said discharge port; and after the bubble has been communicated to the atmosphere, repelling the atmosphere out of said discharge port by means of said moveable member, wherein, in order to prevent the bubble from remaining in the liquid, the atmosphere is released by a tapered portion provided in the vicinity of said free end of said moveable member when said moveable member is returned to its initial position.

7. A method for discharging method according to any one of claims 1, 2, 3, 5 and 6, wherein a first liquid passage communicated with said discharge opening and a second liquid passage having a bubble generating area are provided, and said movable member is disposed between said first liquid passage and said bubble generating area, and further wherein said movable member is displaced by generating the bubble in said bubble generating area so that the bubble is guided toward said discharge opening while regulating growth of the bubble.

8. A method for discharging method according to claim 7, wherein the liquid supplied to said first liquid passage is the same as the liquid supplied to said second liquid passage.

9. A method for discharging method according to claim 8, wherein the liquid supplied to said first liquid passage differs from the liquid supplied to said second liquid passage.

10. A method for discharging method according to any one of claims 1, 2, 3, 5 and 6, wherein a heat generating element for generating the bubble in the liquid is provided at a position confronting to said movable member, and a bubble generating area is defined between said movable member and said heat generating element.

11. A method for discharging method according to claim 10, wherein said free end of said movable member is situated at a downstream side of a center of an area of a heat generating element in a liquid flowing direction.

12. A method for discharging method according to claim 10, wherein stepped portions for defining a recess extending from said heat generating element toward an upstream direction are formed on a substrate on which said heat generating elements are disposed, by pattern-etching, and a second heat generating element is disposed on an inclined surface defining said stepped portions and inclining toward said discharge opening.

13. In a liquid discharging head for discharging ink:

a discharge port from which ink is discharged;

a bubble forming mechanism;

a moveable member having a free end which is displaceable in accordance with the growth of a bubble formed by said bubble forming mechanism and which is arranged to direct the growth of said bubble toward said discharge port so that the bubble becomes communicated with external air at an area of said discharge port, said moveable member being positioned to repel atmosphere out of said discharge port.

14. A liquid discharging head according to claim 13, wherein, when the bubble is communicated with the atmosphere, a liquid passage communicated with a liquid supply source to receive the liquid from said liquid supply source is not blocked by the bubble.

15. A liquid discharging head according to claim 13, wherein the bubble is communicated with the atmosphere in a condition that inner pressure of the bubble is lower than atmospheric pressure.

16. A liquid discharging head according to any one of claims 13, 14 and 15, wherein a heat generating element is used for generating the bubble in the liquid, and the bubble generated in the liquid by said heat generating element is communicated with the atmosphere through said discharge opening under a condition that a distance 1*a* between an end of said heat generating element nearer to said discharge opening and an end of the bubble nearer to said discharge opening and a distance 1*b* between an end of said heat generating element remote from said discharge opening and an end of the bubble remote from said discharge opening are selected to have a relation of $\mathbf{1}a/\mathbf{1}b \geqq 1$.

17. In a liquid discharging head for discharging ink:

a discharge port from which ink is discharged;

a bubble forming mechanism;

a moveable member having a free end which is displaceable in accordance with the growth of a bubble formed by said bubble forming mechanism and which is arranged to direct the growth of said bubble toward said discharge port so that the bubble becomes communicated with external air at an area of said discharge port, said moveable member being positioned to repel atmosphere out of said discharge port, wherein, in order to prevent the bubble from remaining in the liquid, the atmosphere is released by a tapered portion provided in the vicinity of said free end of said moveable member when said moveable member is returned to its initial position.

18. A liquid discharging head according to any one of claims 13, 14, 15 and 17, wherein a first liquid passage communicated with said discharge opening and a second liquid passage having a bubble generating area are provided, and said movable member is disposed between said first liquid passage and said bubble generating area, and further wherein said movable member is displaced by generating the bubble in said bubble generating area so that the bubble is guided toward said discharge opening while regulating growth of the bubble.

19. A liquid discharging head according to claim 18, wherein the liquid supplied to said first liquid passage is the same as the liquid supplied to said second liquid passage.

20. A liquid discharging head according to claim 18, wherein the liquid supplied to said first liquid passage differs from the liquid supplied to said second liquid passage.

21. A liquid discharging head according to any one of claims 13, 14, 15 and 17, wherein a heat generating element for generating the bubble in the liquid is provided at a position confronting to said movable member, and a bubble generating area is defined between said movable member and said heat generating element.

22. A liquid discharging head according to claim 21, wherein said free end of said movable member is situated at a downstream side of a center of an area of a heat generating element in a liquid flowing direction.

23. A liquid discharging head according to claim 20, wherein stepped portions for defining a recess extending from said heat generating element toward an upstream direction are formed on a substrate on which said heat generating elements are disposed, by pattern-etching, and a second heat generating element is disposed on an inclined surface defining said stepped portions and inclining toward said discharge opening.

24. A head cartridge comprising:

a liquid discharging head according to any one of claims 13, 14, 15, and 17; and a liquid container connected to supply the liquid to be supplied to said liquid discharging head.

25. A head cartridge comprising:

a liquid discharging head according to claims 19; and a liquid container connected to supply first liquid to said first liquid passage and second liquid to said second liquid passage.

26. A recording apparatus comprising:

a liquid discharging head according to any one of claims 13, 14, 15, and 17; and a drive signal supplying means connected to supply a drive signal for discharging the liquid from said liquid discharging head.

27. A recording apparatus comprising:

a liquid discharging head according to any one of claims 13, 14, 15, and 17; and a recording medium conveying means for conveying a recording medium discharged from said liquid discharging head.

28. A method for discharging method according to claim 4, wherein a first liquid passage communicated with said discharge opening and a second liquid passage having a bubble generating area are provided, and said movable member is disposed between said first liquid passage and said bubble generating area, and further wherein said movable member is displaced by generating the bubble in said bubble generating area so that the bubble is guided toward said discharge opening while regulating growth of the bubble.

29. A method for discharging method according to claim 4, wherein a heat generating element for generating the bubble in the liquid is provided at a position confronting to said movable member, and a bubble generating area is defined between said movable member and said heat generating element.

30. A method for discharging method according to claim 7, wherein a heat generating element for generating the bubble in the liquid is provided at a position confronting to said movable member, and a bubble generating area is defined between said movable member and said heat generating element.

31. A method for discharging method according to claim 8, wherein a heat generating element for generating the bubble in the liquid is provided at a position confronting to said movable member, and a bubble generating area is defined between said movable member and said heat generating element.

32. A method for discharging method according to claim 9, wherein a heat generating element for generating the bubble in the liquid is provided at a position confronting to said movable member, and a bubble generating area is defined between said movable member and said heat generating element.

33. A method for discharging method according to claim 11, wherein stepped portions for defining a recess extending from said heat generating element toward an upstream direction are formed on a substrate on which said heat generating elements are disposed, by pattern-etching, and a second heat generating element is disposed on an inclined surface defining said stepped portions and inclining toward said discharge opening.

34. A liquid discharging head according to claim 16, wherein a first liquid passage communicated with said discharge opening and a second liquid passage having a bubble generating area are provided, and said movable member is disposed between said first liquid passage and said bubble generating area, and further wherein said movable member is displaced by generating the bubble in said bubble generating area so that the bubble is guided toward said discharge opening while regulating growth of the bubble.

35. A liquid discharging head according to claim 16, wherein a heat generating element for generating the bubble in the liquid is provided at a position confronting to said movable member, and a bubble generating area is defined between said movable member and said heat generating element.

36. A liquid discharging head according to claim 18, wherein a heat generating element for generating the bubble in the liquid is provided at a position confronting to said movable member, and a bubble generating area is defined between said movable member and said heat generating element.

37. A liquid discharging head according to claim 19, wherein a heat generating element for generating the bubble in the liquid is provided at a position confronting to said movable member, and a bubble generating area is defined between said movable member and said heat generating element.

38. A liquid discharging head according to claim 20, wherein a heat generating element for generating the bubble in the liquid is provided at a position confronting to said movable member, and a bubble generating area is defined between said movable member and said heat generating element.

39. A liquid discharging head according to claim 21, wherein stepped portions for defining a recess extending from said heat generating element toward an upstream direction are formed on a substrate on which said heat generating elements are disposed, by pattern-etching, and a second heat generating element is disposed on an inclined surface defining said stepped portions and inclining toward said discharge opening.

40. A liquid discharging head according to claim 22, wherein stepped portions for defining a recess extending from said heat generating element toward an upstream direction are formed on a substrate on which said heat generating elements are disposed, by pattern-etching, and a second heat generating element is disposed on an inclined surface defining said stepped portions and inclining toward said discharge opening.

41. A head cartridge comprising:

a liquid discharging head according to claim 13; and a liquid container connected to supply liquid to said liquid discharging head.

42. A head cartridge comprising:

a liquid discharging head according to claim 14; and a liquid container connected to supply the liquid to said liquid discharging head.

43. A head cartridge comprising:

a liquid discharging head according to claim 15; and a liquid container connected to supply the liquid to said liquid discharging head.

44. A head cartridge comprising:

a liquid discharging head according to claim 16; and a liquid container connected to supply the liquid to said liquid discharging head.

45. A head cartridge comprising:

a liquid discharging head according to claim 18; and a liquid container connected to supply the liquid to said liquid discharging head.

46. A head cartridge comprising:

a liquid discharging head according to claim 21; and a liquid container connected to supply the liquid to said liquid discharging head.

47. A head cartridge comprising:

a liquid discharging head according to claim 18; and a liquid container connected to supply first liquid to said first liquid passage and second liquid to said second liquid passage.

48. A recording apparatus comprising: a liquid discharging head according to claim 13; and a drive signal supplying means connected to supply a drive signal for discharging the liquid from said liquid discharging head.

49. A recording apparatus comprising:

a liquid discharging head according to claim 14; and a drive signal supplying means connected to supply a drive signal for discharging the liquid from said liquid discharging head.

50. A recording apparatus comprising:

a liquid discharging head according to claim 15; and a drive signal supplying means connected to supply a drive signal for discharging the liquid from said liquid discharging head.

51. A recording apparatus comprising:

a liquid discharging head according to claim 16; and a drive signal supplying means connected to supply a drive signal for discharging the liquid from said liquid discharging head.

52. A recording apparatus comprising:

a liquid discharging head according to claim 18; and a drive signal supplying means connected to supply a drive signal for discharging the liquid from said liquid discharging head.

53. A recording apparatus comprising:

a liquid discharging head according to claim 21; and a drive signal supplying means connected to supply a drive signal for discharging the liquid from said liquid discharging head.

54. A recording apparatus comprising:

a liquid discharging head according to claim 13; and a recording medium conveying means positioned to convey recording medium to receive the liquid discharged from said liquid discharging head.

55. A recording apparatus comprising:

a liquid discharging head according to claim 14; and a recording medium conveying means positioned to convey a recording medium to receive the liquid discharged from said liquid discharging head.

56. A recording apparatus comprising:

a liquid discharging head according to claim 15; and a recording medium conveying means positioned to convey a recording medium to receive the liquid discharged from said liquid discharging head.

57. A recording apparatus comprising:

a liquid discharging head according to claim 16; and a recording medium conveying means positioned to convey a recording medium to receive the liquid discharged from said liquid discharging head.

58. A recording apparatus comprising:

a liquid discharging head according to claim 18; and a recording medium conveying means positioned to convey a recording medium to receive the liquid discharged from said liquid discharging head.

59. A recording apparatus comprising: 2 a liquid discharging head according to claim 21; and a recording medium conveying means positioned to convey a recording medium to receive the liquid discharged from said liquid discharging head.

60. A method according to claim 11 wherein stepped portions for defining a recess extending from said heat generating element toward an upstream direction are formed on a substrate on which said heat generating elements are disposed, by pattern etching, and a second heat generating element is disposed on an inclined surface defining said stepped portions and inclining toward said discharge opening.

61. A head cartridge comprising:

a liquid discharging head according to claim 19; and a liquid container connected to supply liquid to said liquid discharging head.

62. A head cartridge comprising:

a liquid discharging head according to claim 20; and a liquid container connected to supply liquid to said liquid discharging head.

63. A head cartridge comprising:

a liquid discharging head according-to claim 22; and a liquid container connected to supply liquid to said liquid discharging head.

64. A head cartridge comprising:

a liquid discharging head according to claim 23; and a liquid container connected to supply liquid to said liquid discharging head.

65. A head cartridge comprising:

a liquid discharging head according to claim 20; and a liquid container connected to supply a first liquid to said first liquid passage and second liquid to said second liquid passage.

66. A liquid recording apparatus comprising:

a liquid discharging head according to claim 19; and a drive signal supplying means connected to supply a drive signal for discharging the liquid from said liquid discharging head.

67. A liquid recording apparatus comprising:

a liquid discharging head according to claim 20; and a drive signal supplying means connected to supply a drive signal for discharging the liquid from said liquid discharging head.

68. A liquid recording apparatus comprising:

a liquid discharging head according to claim 22; and a drive signal supplying means connected to supply a drive signal for discharging the liquid from said liquid discharging head.

69. A liquid recording apparatus comprising:

a liquid discharging head according to claim 23; and a drive signal supplying means connected to supply a drive signal for discharging the liquid from said liquid discharging head.

70. A recording apparatus comprising:

a liquid discharging head according to claim 19; and a recording medium conveying means positioned for conveying a recording medium to received liquid discharged from said liquid discharging head.

71. A recording apparatus comprising:

a liquid discharging head according to claim 20; and a recording medium conveying means positioned for conveying a recording medium to receive liquid discharge from said liquid discharging head.

72. A recording apparatus comprising:

a liquid discharging head according to claim 22; and a recording medium conveying means positioned for conveying a recording medium to receive liquid discharged from said liquid discharging head.

73. A method according to claim 1, wherein:

in response to the displacement of the moveable member to an initial position, the region between the moveable member and a substrate is rapidly refilled with ink whereby the atmosphere is repelled out of the discharge port.

74. A liquid discharging head according to claim 13, wherein:

said moveable member is arranged to cause the region between the moveable member and a substrate to become rapidly refilled with ink upon displacement of said moveable member to an initial position, whereby the atmosphere is repelled out of the discharge port.

* * * * *

UNITED STATES PATENT AND TRADEMARK OFFICE

CERTIFICATE OF CORRECTION

PATENT NO. : 6,270,200 B1
DATED : August 7, 2001
INVENTOR(S) : Hiroyuki Ishinaga et al.

It is certified that error appears in the above-identified patent and that said Letters Patent is hereby corrected as shown below:

Title page,
Item [54], Title, "AN" should read -- ND --;
Item [56], References Cited, FOREIGN PATENT DOCUMENTS,
"61249768" should read -- 61-249768 --; and
"05124189" should read -- 5-124189 --.
Item [57], ABSTRACT,
"is" (2nd occurrence) should read -- and is --.

Column 1,
Line 1, "AN" should read -- AND --; and
Line 19, "equipments." should read -- equipment. --.

Column 15,
Line 27, "area a" should read -- area α --.

Column 17,
Line 11, "a liquid" should read -- in a liquid --.

Column 19,
Line 24, "n-heputane," should read -- η-heptane --.

Column 21,
Line 9, "etylalcohol" should read -- ethylalcohol --.

Column 23,
Line 23, "high" should read -- highly --.

Column 28,
Lines 12, 24, 50, 60, 63 and 66, "for discharging method" should be deleted.

Column 29,
Line 2, "to" should be deleted;
Lines 5 and 9, "for discharging method" should be deleted.

UNITED STATES PATENT AND TRADEMARK OFFICE

CERTIFICATE OF CORRECTION

PATENT NO. : 6,270,200 B1
DATED : August 7, 2001
INVENTOR(S) : Hiroyuki Ishinaga et al.

It is certified that error appears in the above-identified patent and that said Letters Patent is hereby corrected as shown below:

Column 30,
Line 39, "claims" should read -- claim --;
Lines 56 and 66, "for discharging method" should be deleted.

Column 31,
Lines 1, 13, 43, 49, 55 and 61, "to" should be deleted;
Lines 11 and 17, "for discharging method" should be deleted.

Column 33,
Line 15, "recording" should read -- a recording --;
Line 38, "2" should be deleted;
Line 44, "claim 11" should read -- claim 11, --; and
Line 62, "according-to" should read -- according to --.

Column 34,
Line 37, "received" should read -- receive --; and
Line 43, "charge" should read -- charged --.

Signed and Sealed this

Ninth Day of July, 2002

*Attest:*

*Attesting Officer*

JAMES E. ROGAN
*Director of the United States Patent and Trademark Office*